US007727430B1

(12) United States Patent
Wilson

(10) Patent No.: US 7,727,430 B1
(45) Date of Patent: Jun. 1, 2010

(54) SNOW SHELTER MAKER—AN APPARATUS AND METHOD FOR CREATING A SHELTER BASED ON A HORIZONTAL SURFACE OF REVOLUTION

(76) Inventor: William L. Wilson, 11415 21st Pl. NE., Lake Stevens, WA (US) 98258

( * ) Notice: Subject to any disclaimer, the term of this patent is extended or adjusted under 35 U.S.C. 154(b) by 0 days.

(21) Appl. No.: 12/395,670

(22) Filed: Mar. 1, 2009

Related U.S. Application Data

(60) Provisional application No. 61/032,952, filed on Mar. 1, 2008.

(51) Int. Cl.
*E04B 1/16* (2006.01)
*E04B 1/32* (2006.01)
*E04B 1/00* (2006.01)

(52) U.S. Cl. ..... 264/32; 264/33; 264/34; 52/80.1; 52/745.07

(58) Field of Classification Search ..... 52/80.1, 52/745.07, 749.12, 89; 264/32, 33, 34
See application file for complete search history.

(56) References Cited

U.S. PATENT DOCUMENTS

| | | | | |
|---|---|---|---|---|
| 1,995,692 | A | 3/1935 | Urschel | |
| 3,016,595 | A * | 1/1962 | Durst | 264/32 |
| 3,372,430 | A | 3/1968 | Lowes | |
| 3,376,602 | A | 4/1968 | Lowes | |
| 4,154,423 | A | 5/1979 | Crock | |
| 6,210,142 | B1 | 4/2001 | Huesers | |
| 6,240,686 | B1 * | 6/2001 | Mill | 52/223.1 |

* cited by examiner

*Primary Examiner*—Joseph S Del Sole
*Assistant Examiner*—Jeremiah Smith

(57) ABSTRACT

A method and apparatus for constructing a snow shelter are disclosed. A slip form allows snow or ice crystals to be compacted in situ in large continuous blocks. Each block is built upon the previous as the slip form is rotated incrementally around a generally horizontal axis (175). The slip form is a convex shape. The convex shape, or profile, is tailored to the size and shape of the shelter desired. The resulting shape of the snow shelter is a surface of revolution of the profile of the slip form around a horizontal axis. Variations of the shelter's shape are explained herein. Various embodiments are described herein. Some of the advantages of the embodiments include: faster and more efficient construction, simple operation, and tailored size and shape of the finished shelter.

4 Claims, 17 Drawing Sheets

SNOW SHELTER MAKER—AN APPARATUS AND METHOD FOR CREATING A SHELTER BASED ON A HORIZONTAL SURFACE OF REVOLUTION

CROSS REFERENCE TO RELATED APPLICATIONS

This application claims the benefit of PPA No. 61/032,952, filed 2008 Mar. 1 by the present inventor, which is incorporated by reference.

FEDERALLY SPONSORED RESEARCH

Not Applicable

SEQUENCE LISTING OR PROGRAM

Not Applicable

BACKGROUND OF THE INVENTION

Field

This application relates to the construction of shelters made of snow or ice crystals, specifically to shelters constructed using slip forms rotated around a horizontal axis to create a surface of revolution.

BACKGROUND

Prior Art

Shelters built from compacted snow or ice crystals serve a variety of important functions. In areas that receive heavy snowfalls, where there are virtually no building materials available other than snow or ice, such shelters provide humans with life-saving insulation from cold or other natural elements. Snow shelters are often used in recreational applications, such as winter camping or ice fishing.

Traditional Igloo Construction Method

FIG. 1 demonstrates the early steps of building a traditional igloo from custom shaped blocks cut from compacted snow. A first row of blocks is placed in a circle on the surface where the igloo is to be built. The blocks are carefully shaped so they fit together tightly. Additional layers of blocks are stacked and fitted on the previous. Each block of each additional layer must be shaped such that the block is canted more towards the center of the igloo than the blocks of the previous layer. As the blocks are stacked in circles of successively smaller diameters, the walls arch inward and the top of the shelter is eventually enclosed. The final block that encloses the top acts as a keystone and strengthens the walls of the igloo. Until the keystone is placed, the inward arching walls are fragile. The finished shelter approximates the shape of a hemisphere.

If there is sufficient snow depth for excavation, the blocks for a traditional igloo are removed from inside the perimeter of the igloo. This creates more interior volume without the work required of creating taller walls.

Problems with the Traditional Igloo Construction Method

Building a traditional igloo shelter is a job that requires a significant amount of skill. Cutting and lifting blocks of compacted snow is difficult. The blocks are heavy and lifting from foot level is required. Many of the blocks must be lifted to shoulder height and above.

In many instances, the snow must be compacted prior to cutting the blocks. One method of compaction is accomplished by repeatedly walking with snowshoes over an area of soft or powered snow until sufficient compaction is achieved. This act requires a significant expenditure of energy.

The shape or size of the shelter is entirely determined by the user, and once a mistake is made, it is difficult to correct the mistake by repositioning the blocks already in place. Inexperienced builders often encounter size or shape problems during construction and may not be able to finish an igloo in a reasonable amount of time.

One typical size problem is inaccurately estimating the initial diameter of the igloo. If the diameter is too large, enclosing the top is extremely difficult due to the height of the structure. If the diameter is too small, there isn't enough interior space.

A typical shape problem involves the inward curvature of the walls. If the inward cant of each block is insufficient, the walls once again become too tall. If the inward cant is too great, the structure may collapse.

The size and shape of the individual building blocks is another source of problems. Ideally, large blocks are used. This speeds up construction and reduces the number of gaps between blocks. However, the difficulty of moving such blocks often causes the builder to cut small blocks to reduce the weight. If the blocks are sized or placed in such a way that reduces the thickness of the wall, the resulting wall may not have sufficient strength and may collapse prior to or after completion. This is especially true when the builder overestimates the appropriate size of the igloo. Larger diameter igloos require thicker walls.

Placing the last few blocks of a traditional igloo is difficult. The builder must place the blocks over his or her head from inside the structure. Due to the keystone nature of the last blocks, the blocks must be shaped precisely and there is a significant risk of the previous rows collapsing prior to installation of the final blocks.

Once a traditional igloo is completed, any defects on the interior and exterior surfaces should be corrected.

One reason for correcting defects is that snow is a thermal insulator. That is how the inside of the igloo can be kept warmer than the outside temperature. If there are gaps between the blocks of snow, the insulation value of the igloo decreases.

A second reason for correcting defects on the interior is the formation of water drops. As the inside temperature rises above freezing, water drops form at the lowest point of each discontinuity and eventually fall on the inhabitants. These drops are annoying and potentially dangerous if the inhabitants are depending on the shelter to keep them dry and warm. A smooth internal surface reduces the chance of water-drop formation.

Manually packing snow into each of the gaps and smoothing out the discontinuities between the blocks is time consuming.

The circular shape of the floor plan is not ideal for modern camping. A typical adult sleeps in a rectangular area, often defined by a rectangular sleeping pad. Since a finite number of such rectangles will fit in a circular floor plan, the floor space is not used very efficiently. Typically, between 50 and 70 percent of the available floor space is used for sleeping. FIG. 2 and FIG. 3 demonstrate how occupants can be positioned in circular igloos. Although the excess area might feel spacious, it represents wasted work due to the additional snow that is required for construction. The excess floor space also implies that there is excess interior volume that must be heated, and extra time was required to complete the large structure.

Traditional Igloo Construction Method Using a Mold to Create Blocks

Molds are found in the prior art and are used to create building blocks by packing a mold with loose snow. These molds provide blocks of consistent shape and size. Molds are generally in the shape of a rectangular or trapezoidal solid. U.S. Pat. No. 4,154,423 (Crock, 1979) teaches such a method.

After forming a block of snow, the builder places and adjusts the block, as is done in the traditional method.

Problems with Mold Method

Molds overcome one problem of the traditional method—cutting an improper size block. However, all of the other disadvantages of the traditional method still exist, plus a few new ones:

If dropped, the weight of the snow packed mold can fracture the mold. Damage to equipment might render it inoperable.

Extra work is also required when using a mold. The builder must gather snow, place snow in mold, compact snow in mold, remove compacted snow from mold, carry block to igloo, and place block on igloo. This requires picking up the same snow at least three times (picking up snow to fill the mold, picking up and inverting the packed mold to empty it, and picking up the formed block). Handling the same snow multiple times slows down the construction process and wears out the builder.

A single shape of block cannot be used to accurately create an igloo. The shape of each block should be modified so that the blocks fit together without gaps. This involves cutting away snow that was previously lifted 3 times and took additional work to form and pack. In other words, work is wasted by modifying the shape of each block.

FIG. 4 demonstrates what occurs if rectangular blocks are stacked without shaping. Because of the uniform shape of the blocks, there will be many gaps in the outer surface of the completed shelter, thus compromising the insulation value of the igloo. Even if the blocks are uniformly wedge shaped, they will not fit at all levels of the igloo. Custom shaping must still occur. To create an igloo that had no voids and required no reshaping of blocks, a different mold would be required for each level of the igloo. Such a set of molds would only create one diameter of igloo.

FIG. 5 shows how a rectangular block in an upper row is placed on two blocks in a lower row. None of the blocks have been custom shaped. The overhanging edge 105 of the upper block is a discontinuity and will likely cause the formation of water drops as previously mentioned.

In Situ Slip Form Construction Methods

A slip form is a mold that is designed to cast a block in situ. After the block is formed, the slip form is moved and the next block is created. The form is normally enclosed on three sides so that as the form is filled, the newly created block is automatically joined to the previous block and to the block or surface below it.

FIG. 6 shows a simplified representation of a slip form known in the art. U.S. Pat. No. 6,210,142 (Huesers et al, 2001) teaches how to use such a slip form to build circular based hemispherical or ellipsoidal structures. Slip form 110 is attached to the end of rigid rod 120 which pivots around fixed center anchor 115. The building material is deposited in situ block by block.

Slip forms overcome three problems inherent in traditional or mold formed igloos.

1) Slip forms don't leave gaps like mold formed blocks can. Less re-work is required.

2) The wall thickness is well controlled. There is no risk of building a wall that is too thin, as can happen with the traditional method.

3) The size and shape of the igloo is pre-determined. This eliminates the chance for an inexperienced builder to improperly size or shape an igloo.

Problems with Prior Art Slip Forms

The previously mentioned improvements are significant. However, prior art slip forms also introduce new problems or reinforce old problems: they promote wasted work by creating unnecessary internal volume, they promote wasted work because of the small dimensions of the slip form, enclosing the top of the structure becomes more difficult as the height increases, they can require significant practice to become proficient in their use, and they slow down the construction process.

There are several ways that the slip form described by U.S. Pat. No. 6,210,142 limits the rate at which an igloo can be built. In general, the rate is limited by how fast the form can be filled, packed, adjusted and repositioned. These steps are sequential and cannot be performed simultaneously to speed up the construction process The volume of slip form 110 is a limiting factor on how fast an igloo can be created. A larger volume would allow the user to spend more time filling the form and less time manipulating the form. However, the length of the slip form is limited to a small fraction of the circumference of the penultimate layer of the igloo. This length limitation allows the upper layers to be created, but forces the igloo to be built from a large number of small blocks. The width of the form is limited to the wall thickness, and the height is limited to a practical block height. Thus the volume is constrained. Because slip form 110 is small it must be moved frequently. This frequent movement slows down the building process since blocks cannot be added to the structure during the movement process.

Focusing all labor on the small slip form inevitably causes a production bottle-neck. Two people cannot deliver snow to the form at the same time and snow cannot be delivered during the packing, adjusting, or repositioning steps. One person is dedicated to operating and packing the slip form from inside the igloo. At least one other person must gather snow from outside the perimeter of the igloo and deliver it to the slip form. Thus, at least two people are required to build the igloo, but taking full advantage of more than two people is difficult.

It is almost impossible for a single person to build an igloo using this method since the snow must be gathered from outside the igloo and the slip form must be manipulated and packed from inside the igloo. After the second row of blocks is completed, it becomes very difficult for a person to step over the wall without damaging it. At this point, the wall is too short for a door. In other words, the person manipulating the slip form is stuck inside the perimeter until the wall height becomes sufficient to cut a door.

Most of the snow that fills the slip-form must come from outside the igloo. This implies that more snow is required to create an equivalent interior volume when compared to a traditional igloo where the snow is excavated from the interior of the igloo. The requirement to bring the snow from outside the perimeter is caused by the center pivot point which must not be disturbed during the building process. Also, the interior snow quickly gets trampled down by the operator of the slip form. Once snow is compacted it is difficult to insert and pack into the slip form.

Difficulties are encountered as the height of the igloo wall increases. Functionally, the only open face of the slip form 110 is the top. The snow for each block must be loaded into this opening. The opening is relatively small because of the length and width limitations previously mentioned. Because of the small size of the opening, inserting snow into this opening is relatively difficult when the opening is horizontal. However, as the wall cants inward, the opening in the top of the slip form 110 also cants inward. This inward cant increases the difficulty of filling the slip form. The higher the wall, the more difficult this becomes. This difficulty is amplified because the snow is supplied from outside the perimeter of the igloo. The canted opening faces away from the person loading slip form 110. Inevitably, a significant amount of snow will miss the opening and fall inside the igloo.

Enclosing the top of the structure is difficult using the method described by U.S. Pat. No. 6,210,142. There are two ways that this can be accomplished, but neither one is very effective. If the slip form is used "as is", the opening to the form approaches a vertical orientation. The slip form is above the operator's head and is difficult to fill with snow. The other option is to disassemble the slip form and use only the inner surface that is attached to the rigid rod as a snow support. The slip form operator must hold the snow support surface and rod in position and the person outside the igloo must throw snow onto the surface. The person manipulating the remains of the slip form must work with it over his or her head and attempt to pack snow onto the form from a position where he or she cannot see the work in progress. The person delivering the snow must throw it accurately onto the partially disassembled slip form. Snow that misses the slip form will likely end up inside the igloo or fall on the slip form operator and causes wasted work.

U.S. Pat. No. 6,210,142 teaches the use of an adjustable length rigid pole that can be used to create an ellipsoidal shape. As the wall height increases, the length of the pole is increased in a controlled way. Due to the complexities of the adjustable rigid pole, four additional difficulties are encountered: 1) adjusting the rigid pole can be difficult while wearing gloves or mittens, 2) additional practice is required to become proficient at using this feature, 3) the act of adjusting the pole slows the construction process since blocks cannot be built during the adjustment time, and 4) the height of the structure is increased which amplifies the problem of enclosing the top.

Rigid rod 120 that extends from the pivot point creates an obstacle or a trip hazard. Bending, breaking, or otherwise damaging the pole by an operator stepping or falling on it renders the slip form inoperable.

These limitations inherent in the art taught by U.S. Pat. No. 6,210,142 force inefficiencies and imbalance into the build process and generally slow down the construction of an igloo.

Quinzhee Shelter

A quinzhee (or quinzee) is similar to an igloo, but the construction method is vastly different. Snow is gathered and compacted into a large mound. The mound is then hollowed out and the interior snow is discarded. As can be seen, a large amount of time and energy is wasted by gathering the snow, compacting it, and then discarding it. Only a small percentage of the snow gathered is used for finished shelter.

Snow Cave Shelter

A snow cave is similar to a quinzhee except that the snow is naturally deposited and compacted. While there are numerous methods of building a snow cave, they all require that the amount of snow equivalent to the volume of the cave be discarded. Once again, far more snow is moved than that which is required to build a structure such as a igloo. One other problem is finding an appropriate location with adequate snow depth for excavation.

SUMMARY OF PRIOR ART

Traditional igloos were originally created using only a block cutting tool. This was due to the lack of building materials. The only available construction method was to stack the blocks on each other. Many previous improvements in the art have focused on mimicking the same method of building substantially horizontal layers of blocks. Previous inventors have focused on improving various aspects of the individual block method. Removing the barrier of assembling small individual blocks in horizontal layers is a key to making greater improvements in the art. Another key to making improvements over the prior art is moving only the amount of snow that is necessary to build the structure and only moving it once.

The Need for Improvement

There is a great need for a device or method that fills the following requirements:

- The device or method aids in the creation of a snow shelter without causing unnecessary or excessive physical effort and thus reduces the work required.
- The device or method allows for the snow to be moved or lifted only once.
- The device or method is simple and does not require much practice.
- The device is easy to assemble, adjust, manipulate, and disassemble while the operator is wearing heavy gloves or mittens.
- The device or method accurately and quickly guides the construction of an appropriate sized shelter.
- The device or method helps create a shelter of a size and shape that meets to needs of the users and thus reduces the snow required to build the shelter.
- The device or method generates a smooth interior surface to reduce rework and reduce the chance of water drops forming.
- The device or method generates an exterior surface with few voids to take full advantage of the insulation qualities of the snow.
- The device or method enables a single person to build an entire shelter.
- The device or method promotes efficiency when multiple people use it simultaneously.
- The device or method provides for a large working area and reduces the number of movements of the device.
- The device or method does not restrict whether the snow is gathered from inside or outside the perimeter of the shelter.
- The device is not a trip hazard or obstacle and thus reduces the chance of damage to equipment or injury to the operator.
- The device or method promotes simplicity of construction, including enclosing the top of the shelter.
- The device or method promotes rapid completion of the shelter.
- The device or method helps ensure that adequate wall thickness is maintained.
- The device is easily portable.

SUMMARY

In accordance with one embodiment, a method and apparatus are demonstrated for building a shelter from compacted snow or ice crystals where the basic shape of the shelter is a surface of revolution formed around a horizontal axis.

DRAWINGS

Figures

DRAWINGS

Reference Numerals

Figure 1:
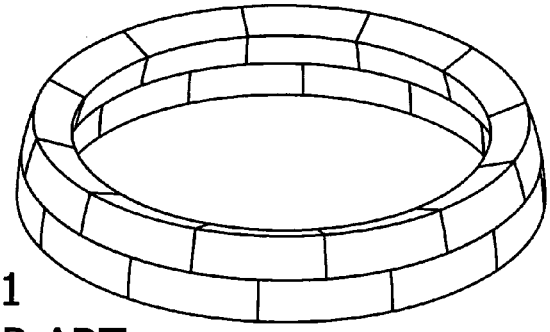
FIG. 1 PRIOR ART
FIG. 1 is an isometric view of two rows of a traditional igloo (prior art).
Figure 2:
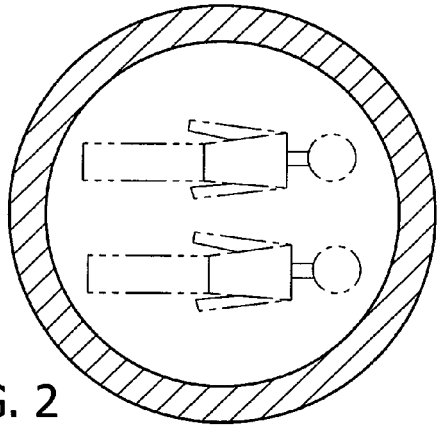
FIG. 2 PRIOR ART
FIG. 2 is a floor plan view of a circular igloo (prior art).
Figure 3:
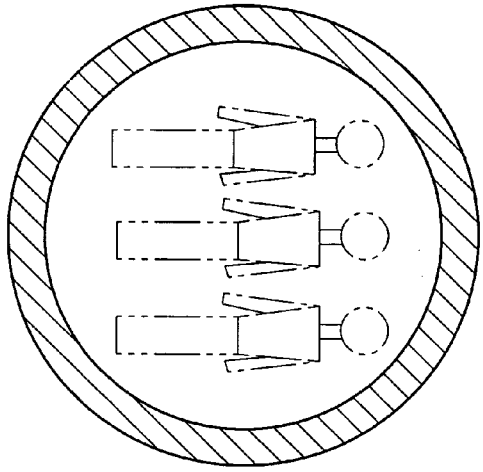
FIG. 3 PRIOR ART
FIG. 3 is a floor plan view of a circular igloo (prior art).
Figure 4:
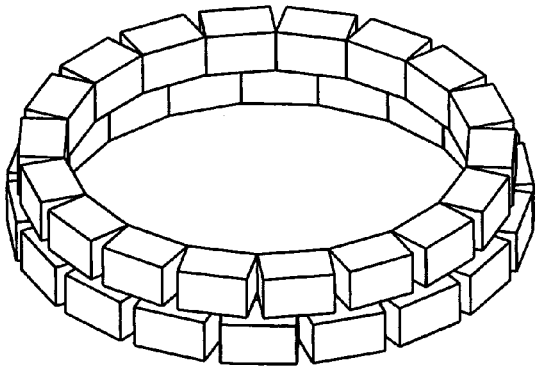
FIG. 4 PRIOR ART
FIG. 4 is an isometric view of two rows of an igloo (prior art).
Figure 5:
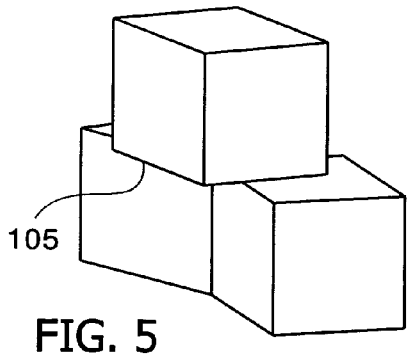
FIG. 5 PRIOR ART
FIG. 5 is an isometric view of three blocks (prior art).
Figure 6:
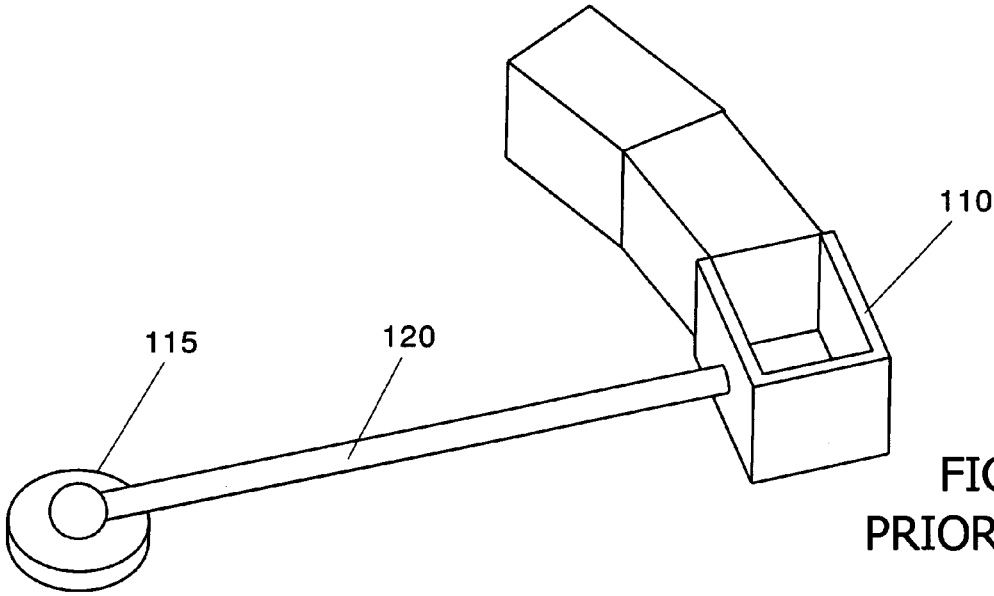
FIG. 6 PRIOR ART
FIG. 6 shows a prior art slip form.

Overhanging edge 105
Slip form 110
Center anchor 115
Rigid rod 120
Snow support assembly 125
Snow support assembly 125A
Snow support assembly 125B
Snow support assembly 125C
Snow support assembly 125D
Lower snow support 126
Lower snow support 126A
Lower snow support 126B
Upper snow support 127
Apex snow support 128
Anchor 130
Bearing surface 131
Helical rib 132
Snow support retaining feature 133
Removal feature 134
Angle support 135
Cylinder 136
Cylinder 137
Exterior surface 140
Interior surface 145
Lateral surface 150
Lateral surface 150A
Semi-circular end surface 155
Cylindrical bearing surface 160
Cylindrical bearing surface 160A
Angle support penetration 165
Apex 167
Radius of curvature 170
Radius of curvature 170A
Interior surface 171
Axis of rotation 175
Sled connector 181
Sled assembly 182
Snow 185A
Snow 185B
Snow 185C
Snow 185E Snow 185F
Snow 185G
Flange 190
Back-off mechanism 195
Handle 200
Cylindrical bearing surface 202
Cylindrical bearing surface 205
Lateral pole 210
Lower lateral pole position 210'
Lower lateral pole position 210"
Lower lateral pole position 210'"
Spreader bars 215
Flexible surface member 220
Flexible surface member 220A
Flexible surface member 220B
Tubular sleeves 225
Rails 235
Snow retainer assembly 240
Snow retainer assembly 240A
Tether 245
End cap 250
End cap 250'
End cap 250"
Straight section 255
Curved section 260

GLOSSARY

The following terms are defined for use in this application:

Curve: A predetermined, continuous, two-dimensional, concatenation of line segments and or arcs that has a beginning point and an end point.

Surface of revolution: A three-dimensional surface created by rotating a curve lying on a plane around a straight line (axis) that lies on the same plane. The term refers to any surface created by a predetermined angular rotation about the axis. The beginning and end points of the curve lie on the axis of rotation.

Horizontal surface of revolution: A surface of revolution formed around an axis of rotation that is generally horizontal.

DETAILED DESCRIPTION

First Embodiment

FIGS. 7 thru 13

Figure 7:
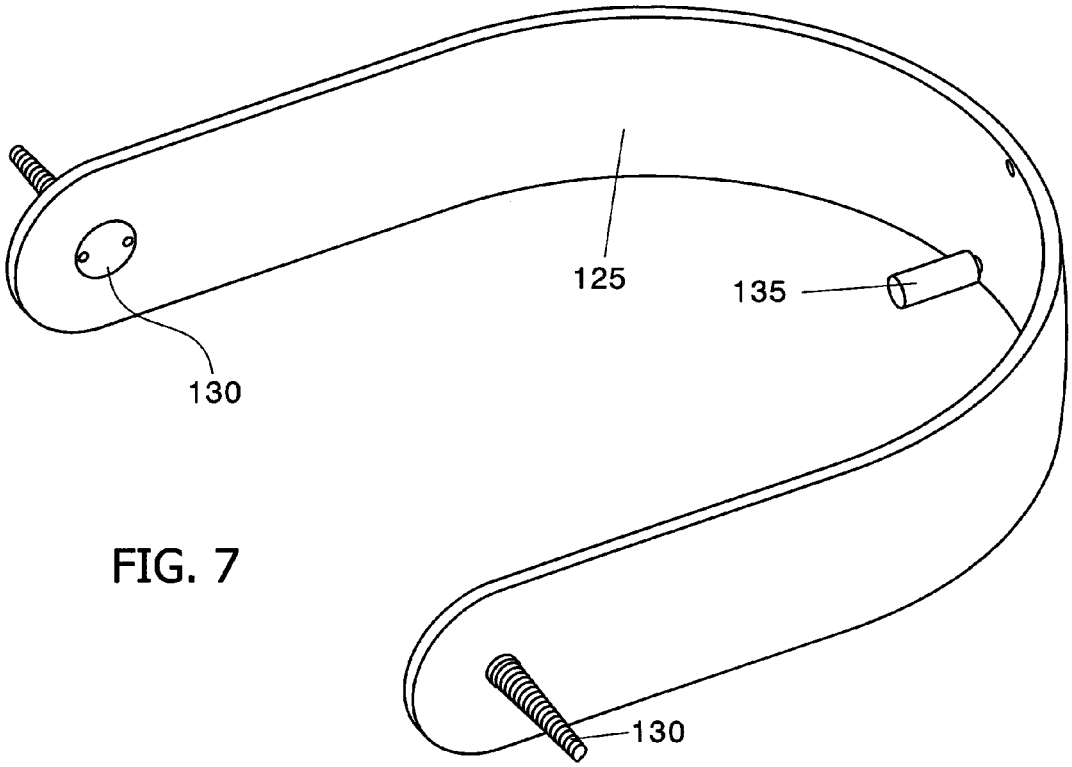
FIG. 7 is an isometric view of a first embodiment of a snow shelter maker in its assembled form.
Figure 8:
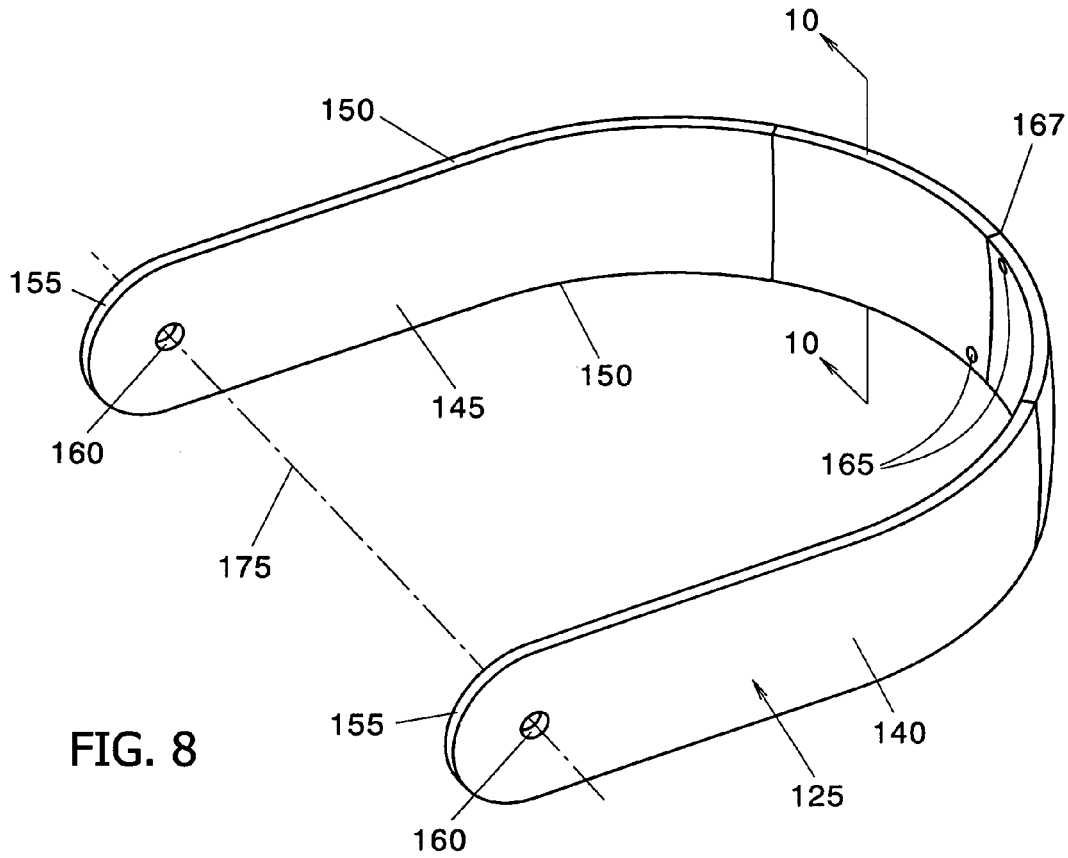
FIG. 8 shows a snow support assembly.

FIG. 7 shows an assembled view of a first embodiment of my snow shelter maker. This embodiment includes a snow support assembly 125, two anchors 130, and an angle support 135. FIG. 8 shows various features of the snow support assembly 125. The snow support assembly 125 forms an elongated, generally convex shape that includes a smooth exterior surface 140, an interior surface 145, two lateral surfaces 150 that are generally parallel, and two semi-circular end surfaces 155 that join tangentially with the two lateral surfaces 150. The semi-circular end surfaces are co-axial. The axis that joins them is axis of rotation 175. The portions of the exterior surface adjacent to each of the semi-circular end surfaces are planar. The two planar portions are parallel to each other and perpendicular to axis of rotation 175. There are two cylindrical bearing surfaces 160 that extend perpendicularly from the planar portion of the exterior surface 140 to the interior surface 145. Each cylindrical bearing surface 160 is co-axial with the axis of rotation 175. Each cylindrical bearing surface 160 corresponds to bearing surfaces 131 of FIG. 11. Apex 167 is the point or set of points (i.e. in this embodiment, an arc) farthest from axis of rotation 175. Near apex 167 there are two angle support penetrations 165. One angle support penetration is near the upper lateral surface 150 and the other is near the lower lateral surface 150. Each angle support penetration connects the interior surface 145 to the exterior surface 140. The snow support assembly forms a structure that is capable of supporting a snow load placed on the exterior surface.

Figure 9:
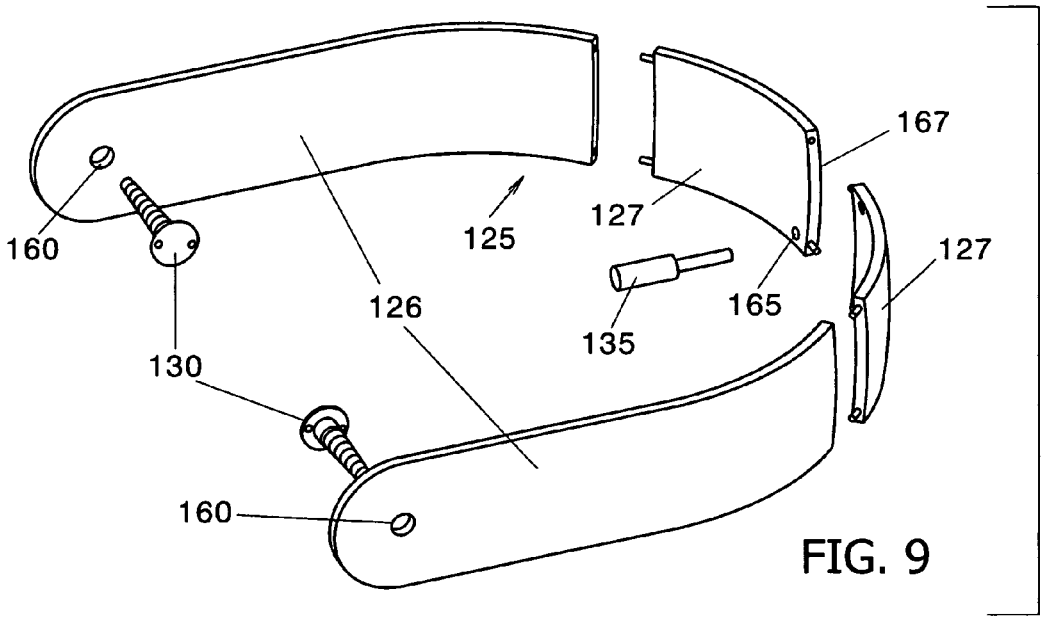
FIG. 9 shows an exploded view of FIG. 7.

FIG. 9 is an exploded view of FIG. 7. Snow support assembly 125 comprises two identical lower snow supports 126 and two identical upper snow supports 127. Each lower support is connected to an upper support and the upper supports are connected together at apex 167. The method of connection shown is a common peg-and-hole method, but other methods known in the art also work. Each end of the snow support assembly is rotationally connected to one anchor 130 by way of cylindrical bearing surfaces 160. Angle support 135 is inserted into lower angle support penetration 165.

Figure 10:
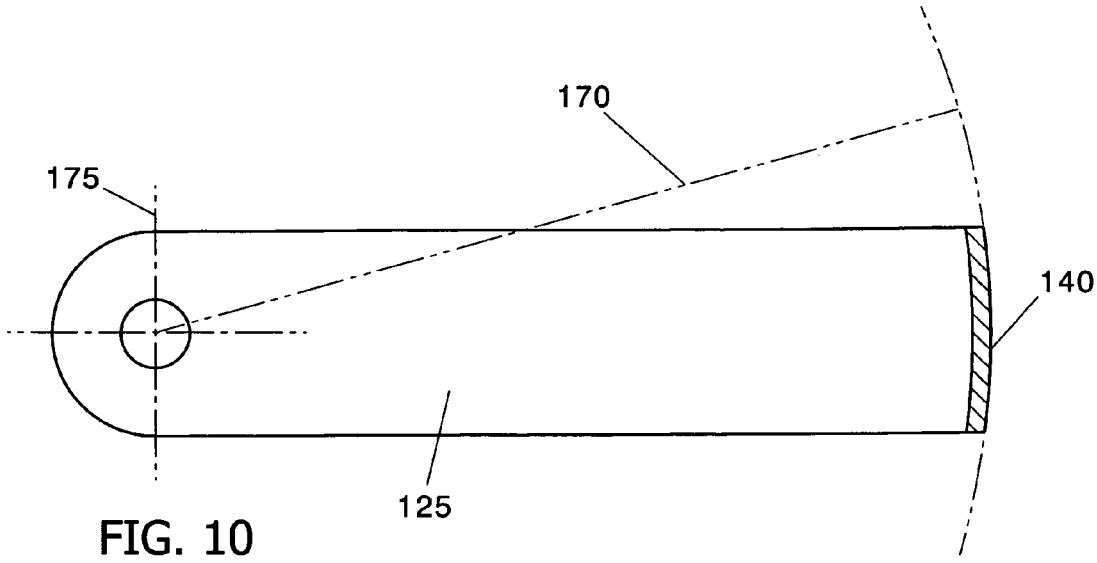
FIG. 10 shows a section view of a snow support assembly as defined by section line 10-10 in FIG. 8.

FIG. 10 is a section view, defined in FIG. 8 of snow support assembly 125. The section cut is created by a plane that is perpendicular to the axis of rotation 175. The radius of curvature 170 of the exterior surface 140 represents the curvature of the exterior surface 140 at all locations of that plane along the axis of rotation 175 unless exterior surface 140 at that location is planar and perpendicular to the axis of rotation.

Figure 11:
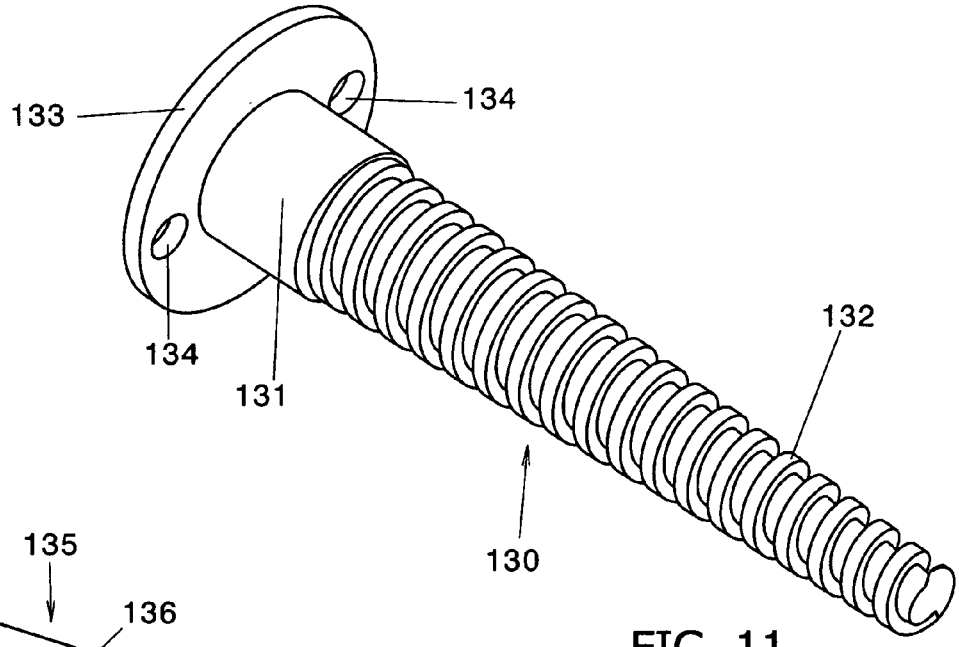
FIG. 11 shows an isometric view of a first embodiment of an anchor.

FIG. 11 shows one embodiment of an anchor. Anchor 130 is embedded in snow and is used to limit the motion of the snow support. Two anchors, placed co-axially, constrain snow support assembly 125 (FIG. 8) to one degree of freedom (i.e. rotation around axis of rotation 175). The pair of anchors establishes a generally horizontal axis of rotation.

The diameter of bearing surface 131 is slightly smaller than the diameter of cylindrical bearing surfaces 160 (FIG. 9) in the snow support assembly and rotationally connects the snow support assembly to the axis of rotation and allows for smooth rotational motion.

Anchor 130 has snow support retaining feature 133 to prevent the snow support from becoming detached from the anchor while the anchor is fixed to the snow.

The anchor has a retention feature that holds the anchor in the snow until the operator is ready to remove it. In this embodiment, the retention feature is helical rib 132 formed on a tapered cone. Helical rib 132 prevents the anchor from sliding axially through the snow. In this embodiment, removal features 134 in the snow support retaining feature 133 facilitate removal of the anchor from the snow by creating a feature with which the operator can twist the anchor.

Figure 12:
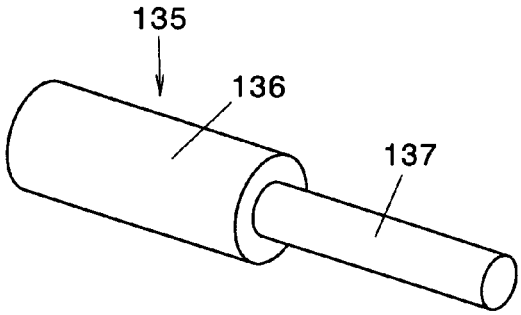
FIG. 12 shows a first embodiment of an angle support.

FIG. 12 shows one embodiment of angle support 135. It comprises two co-axial cylinders of different diameters. The larger diameter cylinder 136 forms a handle that is easy to grasp while the operator is wearing gloves. The smaller diameter cylinder 137 is inserted in the lower of the two angle support penetrations 165 (FIG. 9). The difference in diameter prevents the angle support from being inserted too far. Angle support 135 also serves as a gauge to ensure that adequate wall thickness is maintained. The overall length of the angle support is the minimum acceptable wall thickness (See FIG. 16).

Figure 13:
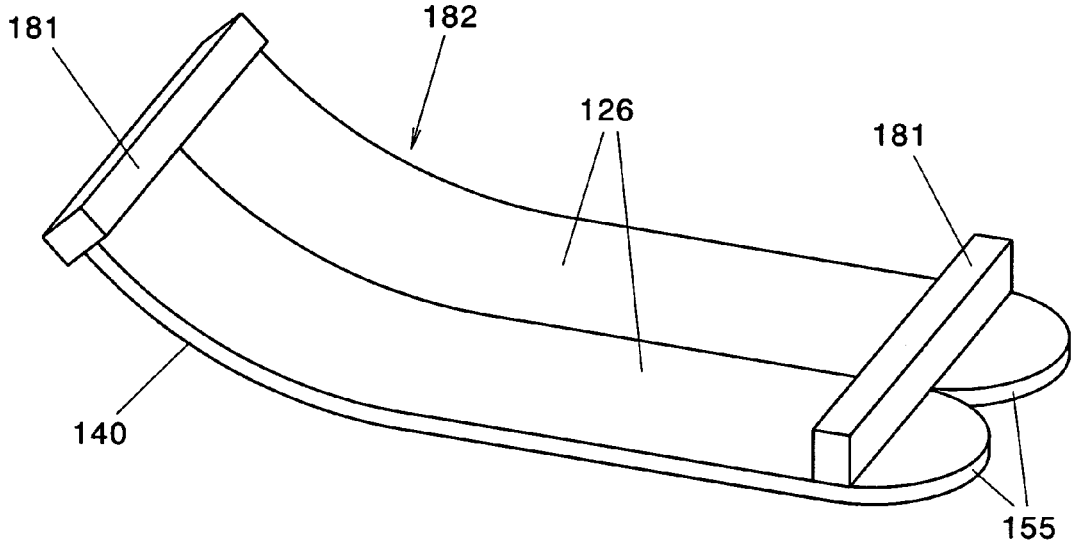
FIG. 13 is a isometric view of an alternate use of components of a snow support assembly.

FIG. 13 shows sled assembly 182 that can be formed from the pair of lower snow supports 126. The two lower snow supports are placed side-by-side with exterior surfaces 140 facing down. Sled connector 181 is attached near the semi-circular end surfaces 155. A second sled connector 181 is attached at the opposite end of the lower snow supports and completes the sled. The method of connection is not shown, but is known in the art. A rope or other similar member (not shown) is attached to sled assembly 182. The assembled sled aids in transportation of the remaining components of the snow shelter maker and any other gear or items that the operator might wish to place on the sled. Attach points, not shown but known in the art, are envisioned on the lower snow supports 126 and sled connectors 181 to secure the load and prevent the load from departing the sled during transportation.

Operation

First Embodiment

FIGS. 14 thru 23

Figure 14:
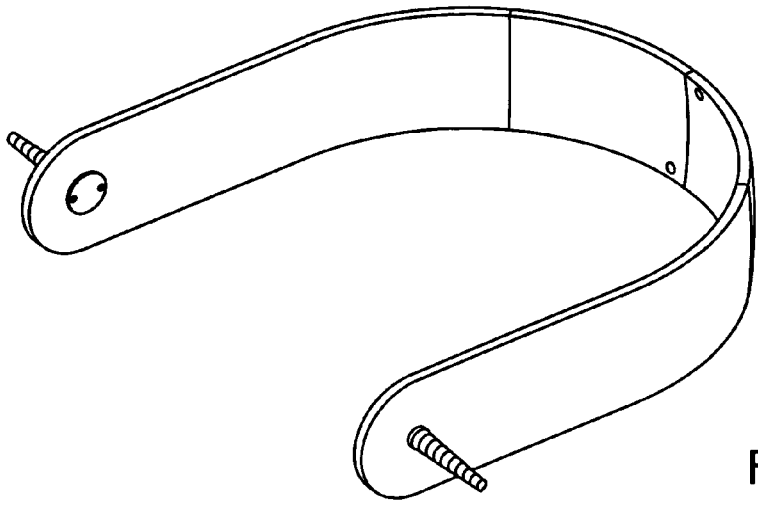
FIG. 14 shows the first step in construction of a snow shelter using the first embodiment of a snow shelter maker.

FIG. 14 shows the first embodiment of the snow shelter maker assembled, positioned on the ground, and ready for construction of a shelter to begin. Angle support 135 is not installed since the snow support assembly is supported by the ground.

Figure 15:
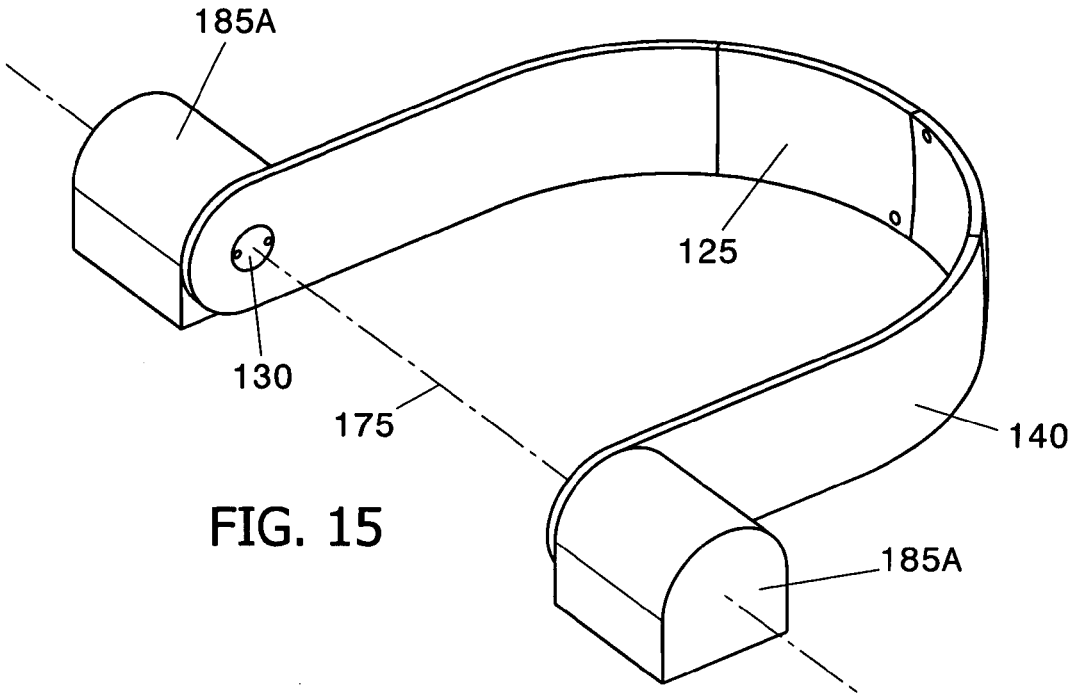
FIG. 15 shows the second step in construction of the shelter.

FIG. 15 shows the first step in building a shelter using the snow shelter maker. Snow 185A is firmly packed around the portion of each anchor 130 that protrudes past exterior surface 140 of snow support assembly 125 so as to rigidly fix each anchor to the surface upon which the shelter is to be built. Fixing the anchors constrains the snow support assembly so that it can only rotate around axis of rotation 175.

Figure 16:
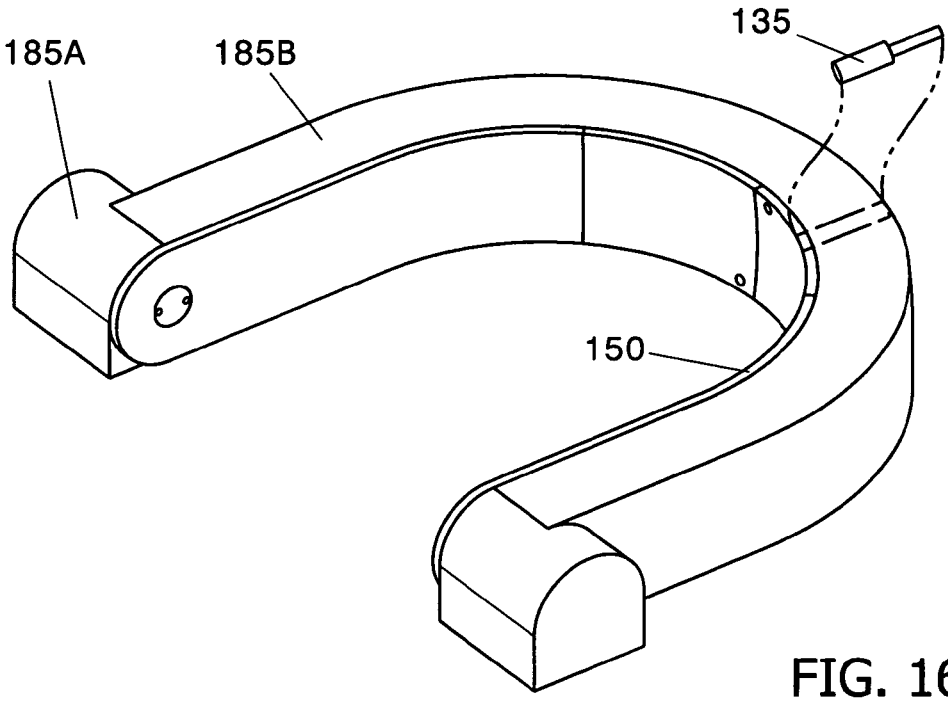
FIG. 16 shows the third step in construction of the shelter.

FIG. 16 illustrates the next step in the construction process. Snow 185B is packed along the entire exterior surface of the snow shelter maker, to a height equivalent to the upper lateral surface 150 of the snow support. Angle support 135 is used as a gauge to ensure that adequate thickness of the shelter wall is maintained throughout construction.

Figure 17:
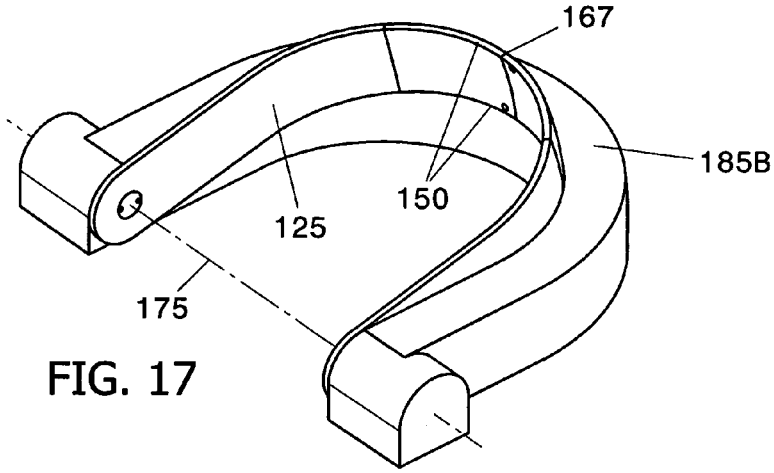
FIG. 17 shows the forth step in construction of the shelter.

FIG. 17 shows the next step in creating the shelter. Snow support assembly 125 is rotated around axis of rotation 175 so that lower lateral surface 150, at apex 167 is placed approximately where upper lateral surface 150 was previously located. Rotation of the snow support is facilitated because the center of the radius of curvature 170 (FIG. 10) of the exterior surface is coincident with axis of rotation 175. Snow 185B does not trap the snow support.

Figure 18:
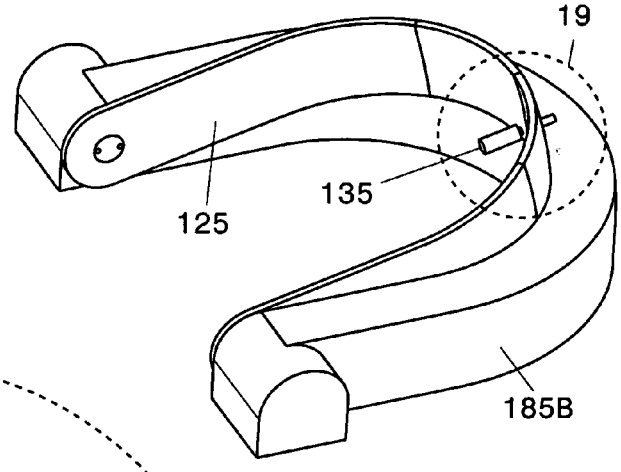
FIG. 18 shows the fifth step in construction of the shelter.
Figure 19:
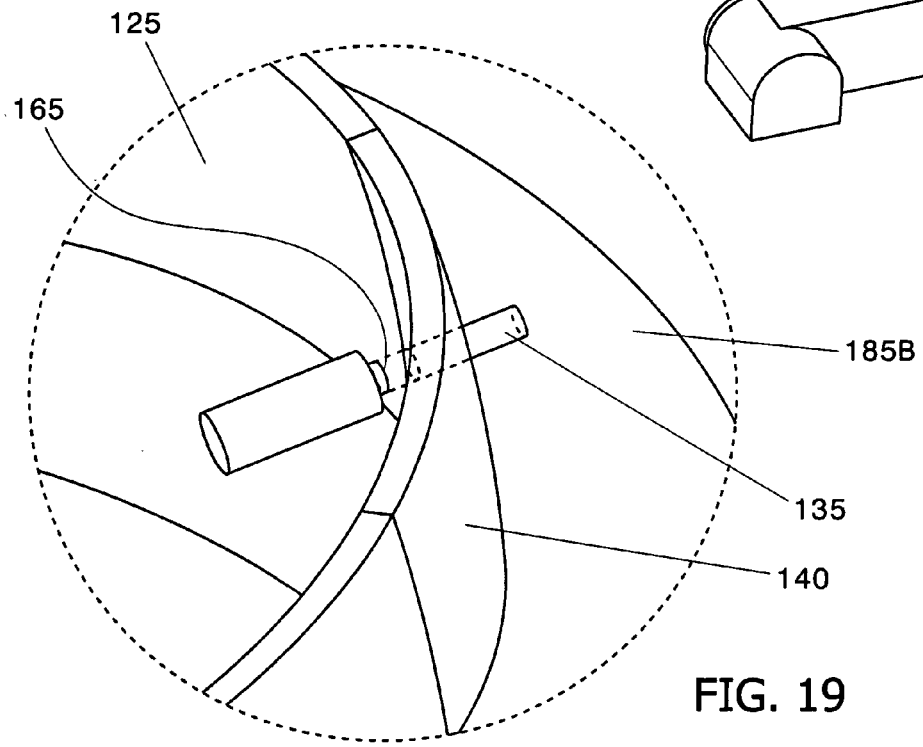
FIG. 19 shows enlarged detail from FIG. 18.

FIG. 18 and FIG. 19 show how angle support 135 is inserted into lower angle support penetration 165. The portion of angle support 135 that extends beyond exterior surface 140 of the snow support is placed on or embedded in snow 185B. This prevents rotation of snow support assembly 125. In other words, angle support 135 sequentially restrains snow support 125 to a series of predetermined angular orientations around axis of rotation 175.

Figure 20:
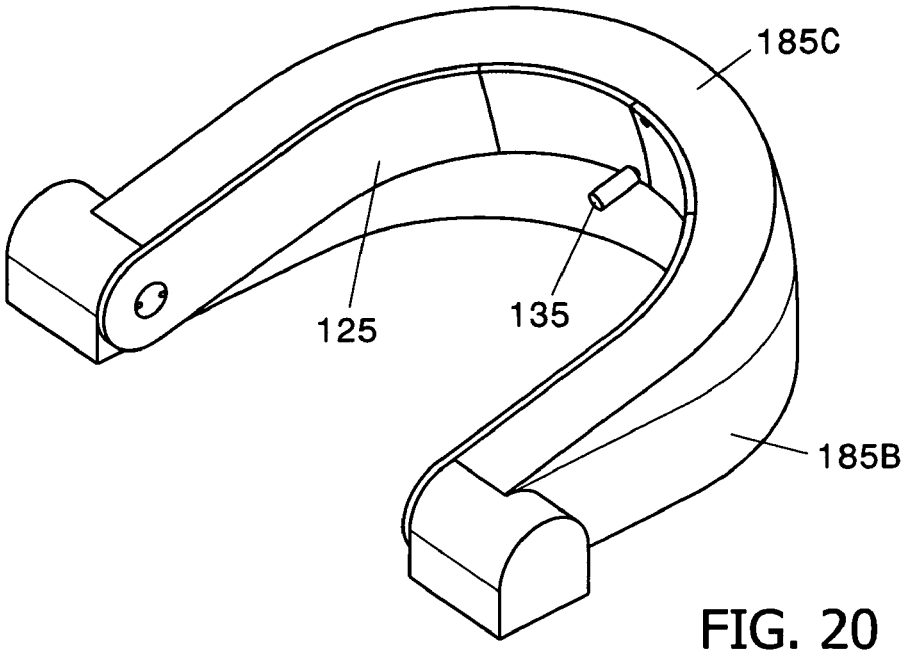
FIG. 20 shows the sixth step in construction of the shelter.

FIG. 20 shows how snow 185C is once again piled and packed around the exterior perimeter of the snow support and on top of the previous layer of snow 185B.

Once the snow is packed to the height of the snow support, angle support 135 is removed and the snow support assembly 125 is moved to its next position and angle support 135 is replaced. This cycle is repeated until the snow support assembly 125 reaches a generally vertical orientation and the first half of the shelter is finished.

Figure 21:
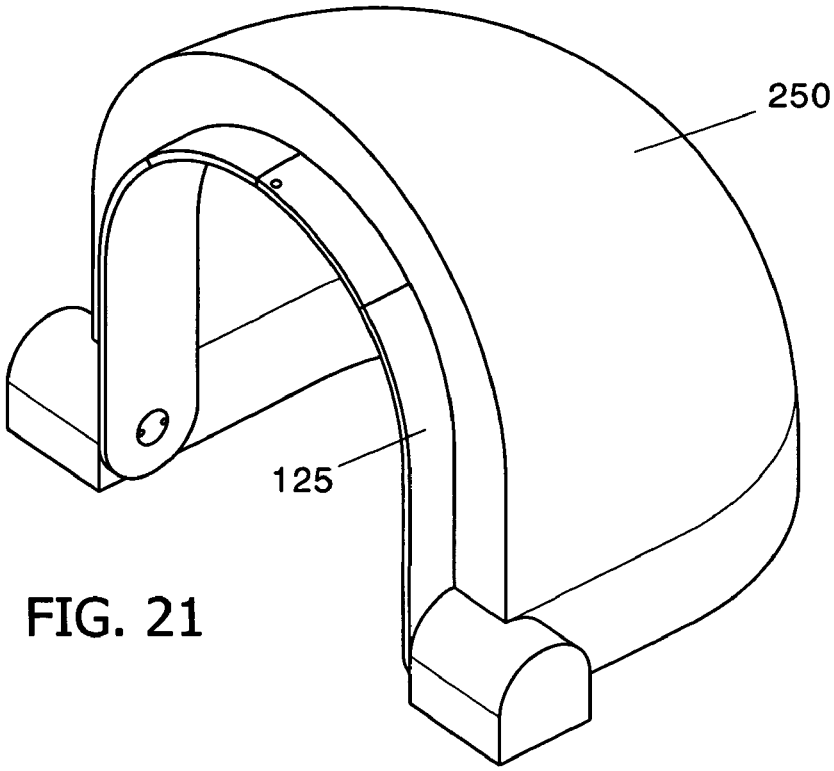
FIG. 21 shows the midpoint of the construction of the shelter.

FIG. 21 shows the completed first half of the shelter with snow support assembly 125 in a vertical orientation. The completed half of the shelter is called end cap 250

Figure 22:
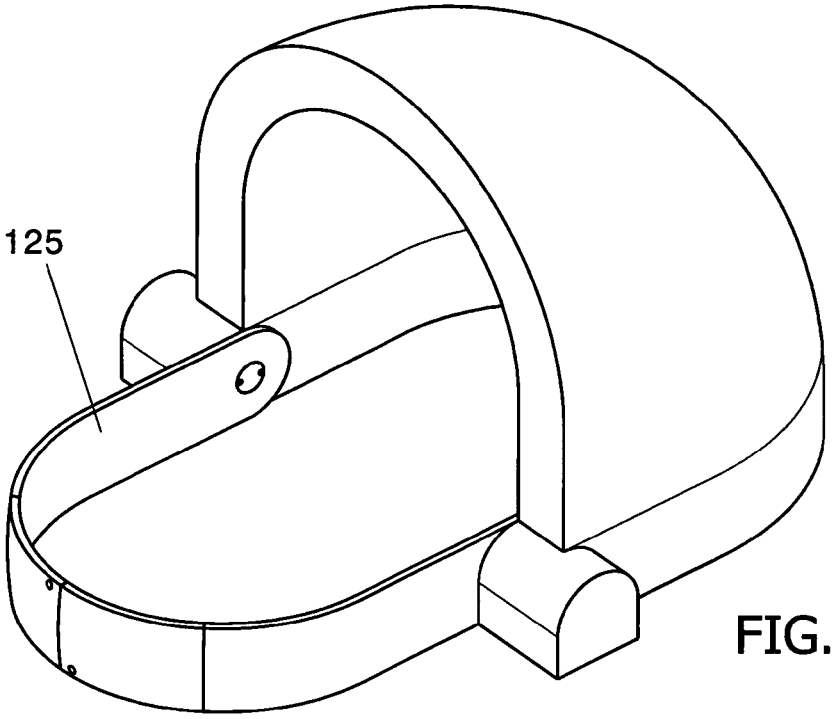
FIG. 22 shows the first step of the construction of the second half of the shelter.

FIG. 22 shows the snow support assembly 125 positioned to begin the second half of the shelter. The steps for completing the first half of the shelter are repeated until the second half of the shelter is complete.

Figure 23:
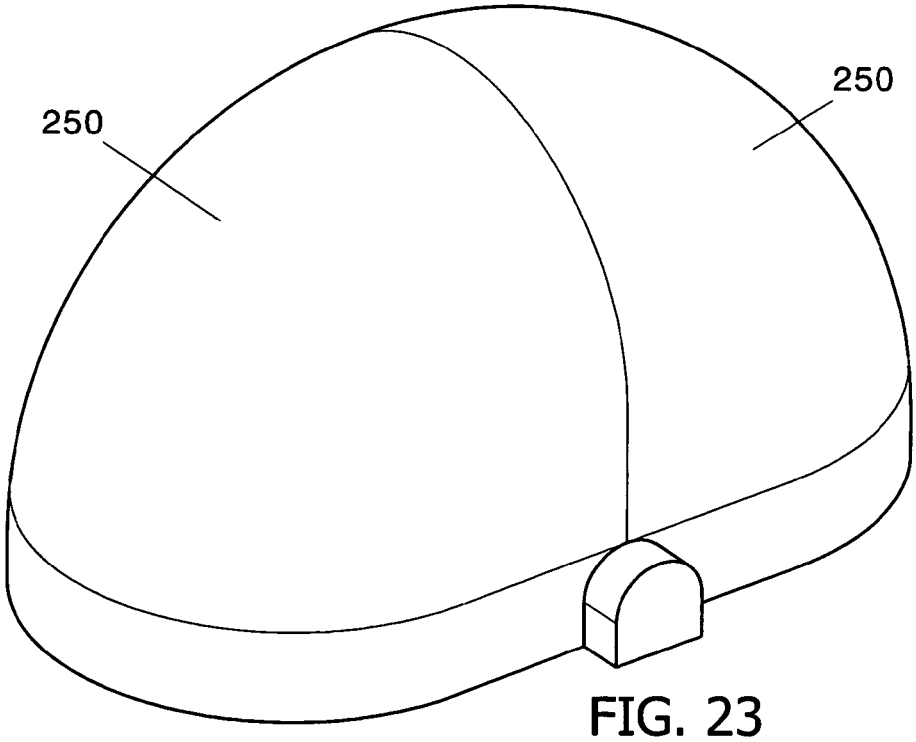
FIG. 23 shows an isometric view of a completed shelter.

FIG. 23 shows a completed shelter. It is made of two end caps 250. The door to access the interior of the shelter is not shown, but would normally be cut into the completed first half of the shelter sometime between the steps shown in FIG. 21 and FIG. 23.

Features of shelters created with the first embodiment of the snow shelter maker—FIGS. 24 thru 28

Some of the features of shelters completed with the first embodiment of the snow shelter maker will be discussed next.

Figure 24:
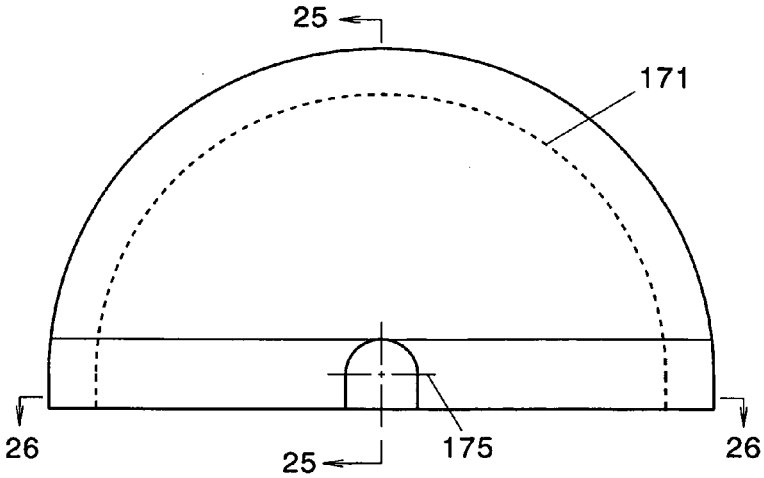
FIG. 24 shows an axial view of a completed shelter.

FIG. 24 shows a view along axis of rotation 175 of the completed shelter. This view shows that as long as the anchors are not moved during the construction process and the wall thickness is constant, the exterior shape of this view will be semi-circular. This is because the shelter is a surface of revolution around axis of rotation 175.

As a result of radius of curvature 170 (FIG. 10) of the snow support assembly, interior surface 171 of the shelter is generally smooth and free of most defects. Thus fewer water drops are likely to form and fall on the occupants.

Figure 25:
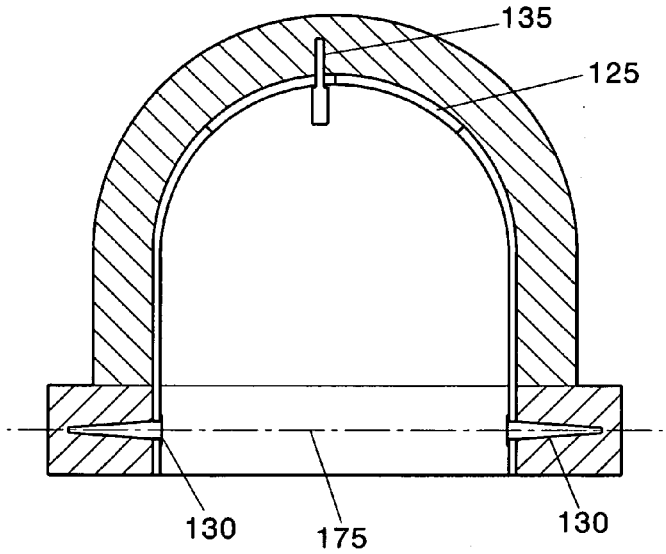
FIG. 25 shows a section view of a shelter as defined by section line 25-25 in FIG. 24.

FIG. 25 is a section view of a shelter as defined by section line 25-25 in FIG. 24. It shows the snow support assembly in a vertical orientation. This view shows that this cross sectional shape of the shelter follows the shape of the snow support. This view of the snow support assembly will be referred to as the profile. As will be shown in later embodiments, the profile of the snow support assembly can vary widely, according to the desired embodiment of the snow support.

When construction is finished, the anchors 130 are removed by rotating the anchors around axis of rotation 175. Because helical rib 132 (FIG. 11) is formed on a tapered cone, anchor 130 will pull free after several revolutions. Snow support assembly 125 is disassembled, and the snow shelter maker is removed from the interior of the shelter.

Figure 26:
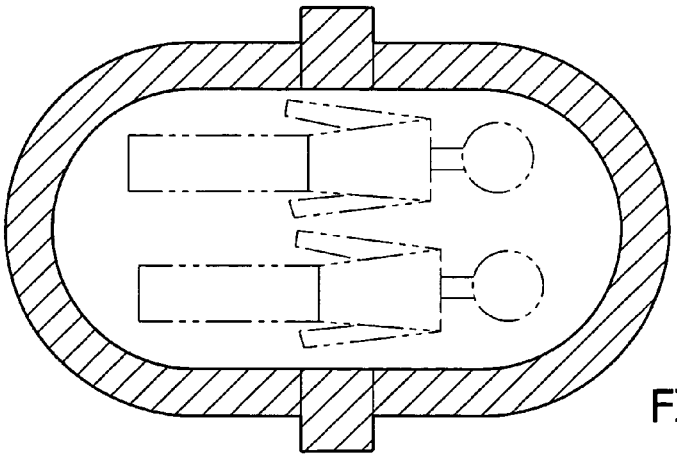
FIG. 26 shows a section view of a shelter as defined by section line 26-26 in FIG. 24.

FIG. 26 is a section view defined by section line 26-26 of FIG. 24. It shows the floor plan of the shelter. The floor plan will vary according to the profile of the snow support. The representation of occupants shows how this floor plan is tailored to fit the occupants and reduce unusable space.

Figure 27:
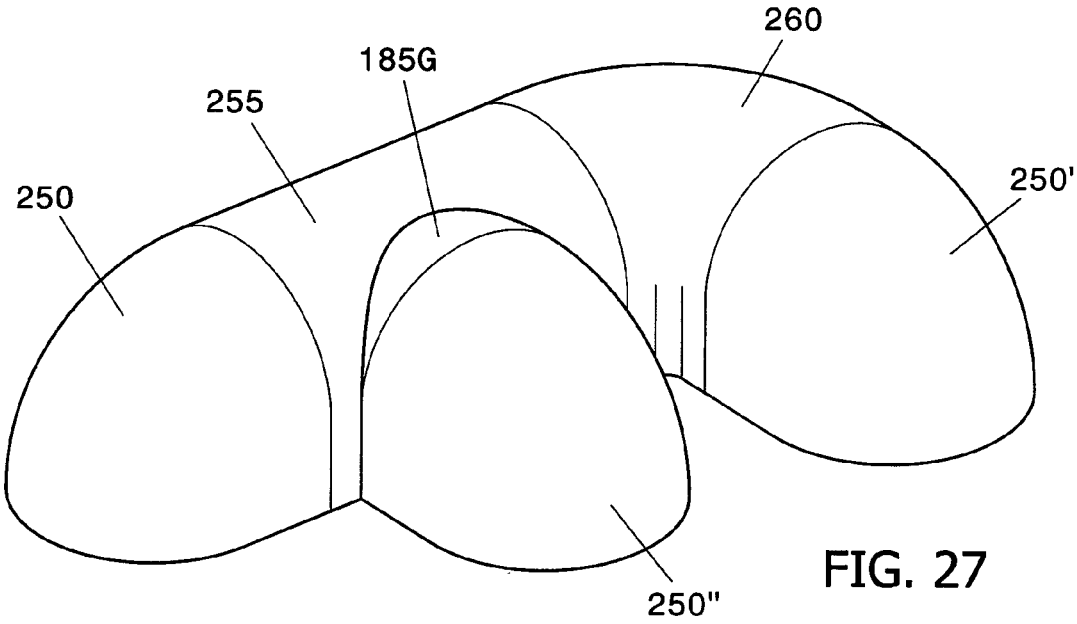
FIG. 27 is an isometric view of a variation of a completed shelter.

FIG. 27 is an isometric view of a variation of a shelter built with the same embodiment of the snow support assembly as used to construct the shelter in FIG. 23. However, the process was varied substantially to create this variation. End cap 250 was created using the steps described in FIGS. 15 thru 21. However, instead of continuing with the step demonstrated in FIG. 22, the anchors and snow support assembly were moved a distance equal to the width of the snow support assembly and the snow support assembly was secured in a vertical orientation. Snow was packed around the perimeter of the snow support assembly. The anchors were then moved again as described. These steps were repeated until straight section 255 was created. Curved section 260 was created in a similar manner as straight section 255 except that one anchor was consistently moved less than the width of the snow support assembly and less than the other anchor. This generates a curved section. The curved section was then terminated with end cap 250' as described previously in FIGS. 22 and 23. (End cap 250' is identical to end cap 250 and is used only for identification purposes within the drawing.)

Straight or curved sections should only be created by this method when the profile of the snow support is a self supporting shape. Profiles that contain large, significantly horizontal, sections should not be used. End cap 250" was created after straight section 255 was created. (End cap 250" is identical to end cap 250 and is used only for identification purposes within the drawing.) This creates a room or alcove off of the structure that it is attached to. The snow shelter maker was placed so as to intersect the existing structure. An aperture (not shown) is cut through the side of straight section 255 to allow access to the interior of 250B. Snow 185G might have to be manually placed if the snow support assembly will not rotate far enough to touch portions of the existing structure.

This representation of a shelter demonstrates one of the infinite number of structures that can be created by intentionally moving the anchors during the construction process. Children and youth will likely enjoy building and playing in such unusual structures.

Figure 28:
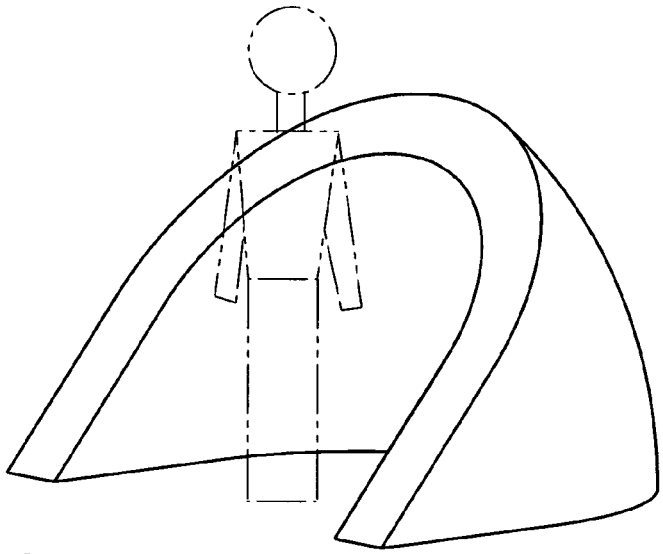
FIG. 28 is an isometric view of a fortress built with a snow shelter maker.

FIG. 28 shows another use. A partially finished structure could be used as a fortress or a defensive structure for snowball fights that children and youth often engage in. A youth is represented in the figure for size comparison.

Description

Alternative Embodiment

FIGS. 29 thru 32

FIGS. 29 thru 32 show four different views of a shelter created with an alternative embodiment of a snow support assembly (not shown). These views demonstrate how a different snow support assembly profile will affect the overall shape of a shelter and its floor plan. The snow shelter maker is not restricted to any particular shape. Instead, different profiles allow the user to choose a snow shelter maker that is optimized for his or her requirements.

Figure 29:
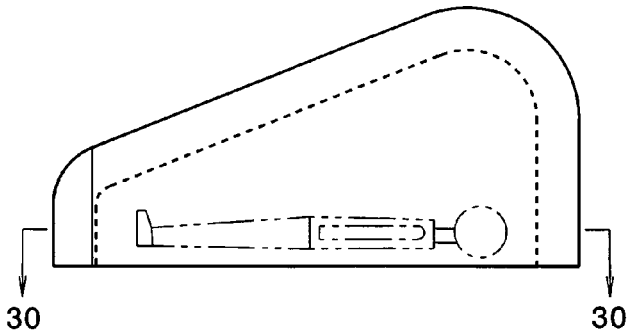
FIG. 29 shows a view of an alternative embodiment of a completed shelter.

FIG. 29 demonstrates a non-traditional profile for a shelter. Notice how the ceiling height is greatest above the head of the occupants. Focusing the volume in this portion of the shelter may be advantageous—this is where an occupant would sit up, enter into a sleeping bag, and do many other activities inside the shelter. Likewise, the volume around the feet of the occupants is reduced. That is the location where very little activity is likely to occur.

Figure 30:
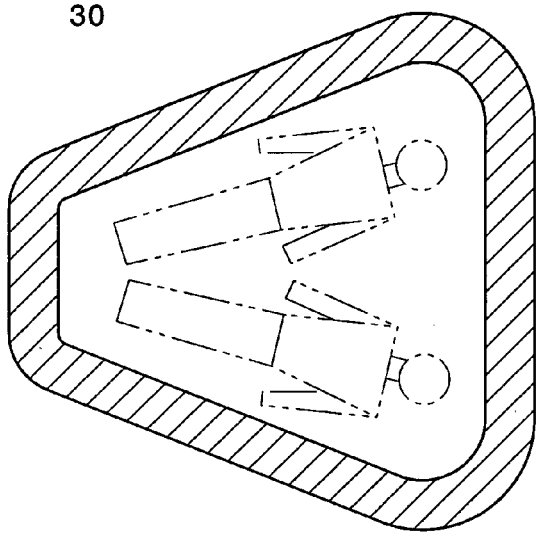
FIG. 30 shows a section view of the shelter defined by section line 30-30 in FIG. 29.

FIG. 30 shows the floor plan of the shelter shown in FIG. 29. Notice how much of the extra floor space is within reach of the occupants. Once again this non-traditional floor plan focuses the space where it is most useable.

Figure 31:
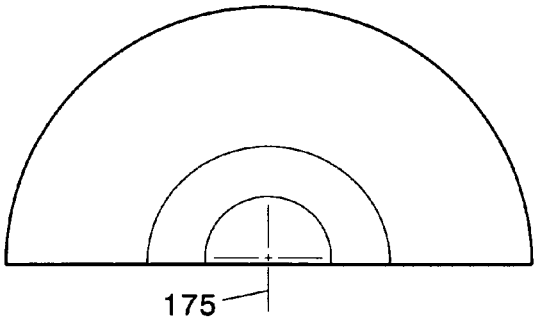
FIG. 31 shows an axial view of the shelter shown in FIG. 29.

FIG. 31 shows the view along axis of rotation 175. The semi-circular shape reminds the reader that this is a surface of revolution.

Figure 32:
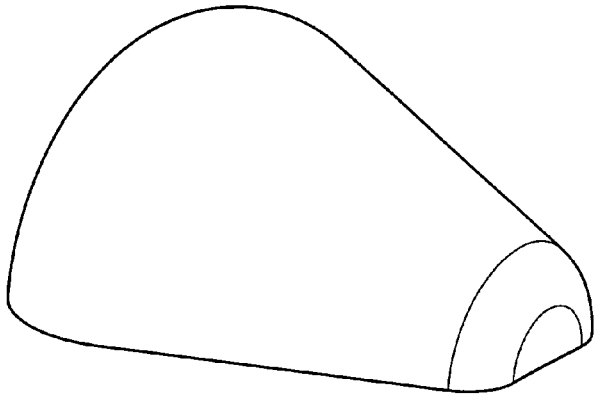
FIG. 32 shows an isometric view of the completed shelter shown in FIG. 29.

FIG. 32 shows an isometric view of the unusual, non-traditional shape of this embodiment of the shelter. The ability to create many different shapes is possible because rotation around a horizontal axis creates a semi-circular cross section (FIG. 31) which is a self supporting shape.

Description

Alternative Embodiment

FIG. 33

Figure 33:
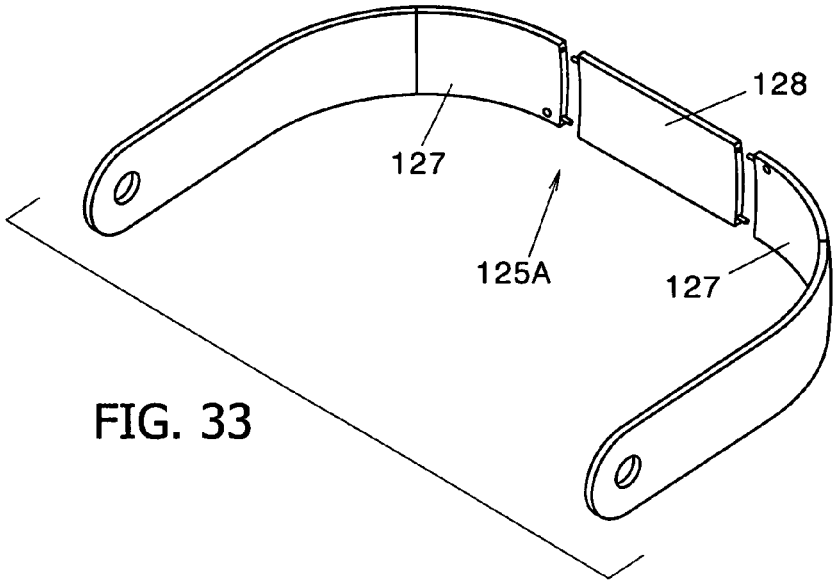
FIG. 33 is an exploded view of an alternative embodiment of a snow support.

FIG. 33 demonstrates how apex snow support 128 can be inserted between the two upper snow supports 127 of snow support assembly 125 (FIG. 9) to create yet a different floor plan. This addition creates snow support assembly 125A. This embodiment converts a two-person snow shelter maker into a three-person shelter maker. The function of the snow support assembly 125A is identical to snow support assembly 125.

Description

Alternative Embodiment

FIG. 34

Figure 34:
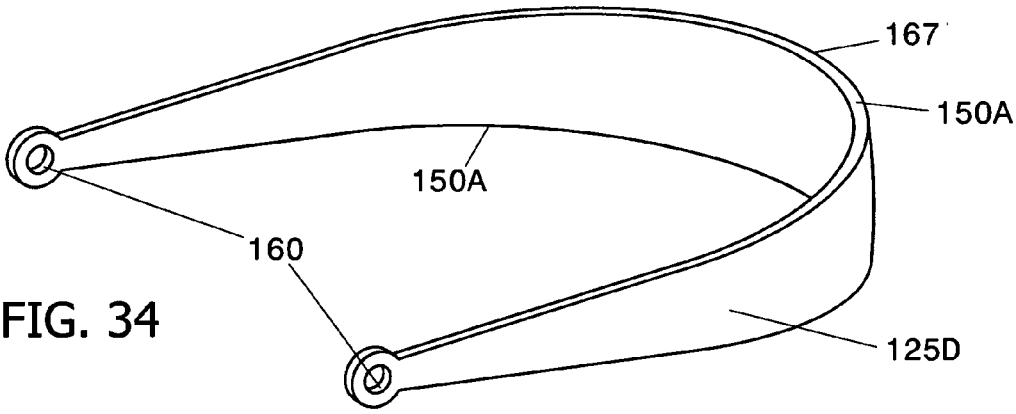
FIG. 34 is an isometric view of an alternative embodiment of a snow support.

FIG. 34 shows snow support assembly 125D, an alternative embodiment of a snow support assembly. Lateral surfaces 150A of this embodiment are not parallel. They are at maximum separation at apex 167 and transition to minimum separation near the cylindrical bearing surfaces 160. This embodiment reduces the weight of the shelter maker and facilitates transportation when a method other that the previously mentioned sled is desired. The function of the snow support assembly 125D is identical to snow support assembly 125. Snow support assembly 125D can be disassembled into multiple pieces (not shown) to aid in transportation. The number of pieces is not important. Disassembly is typical of all embodiments of the snow support assembly.

Description

Alternative Embodiment

FIG. 35

Figure 35:
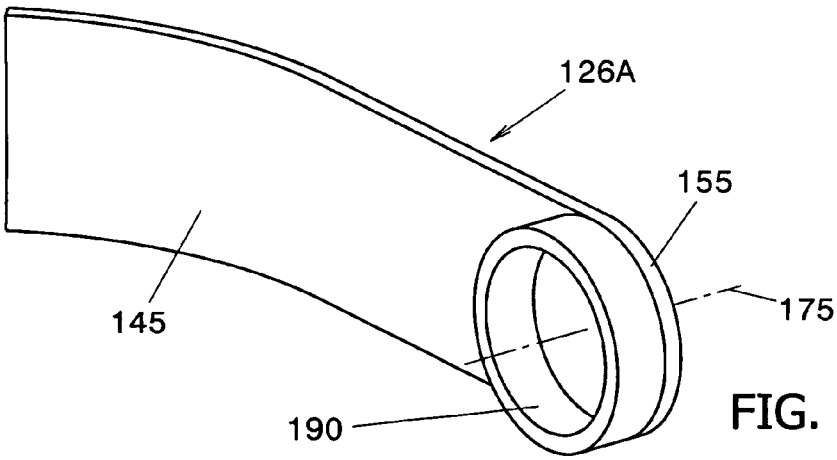
FIG. 35 is an isometric view of an alternative embodiment of a lower snow support.

FIG. 35 shows an alternative embodiment of a lower snow support. It combines the functions of anchor 130 (FIG. 11) and lower snow support 126 (FIG. 9) into lower snow support 126A. Lower snow support 126A is identical to lower snow support 126 except that circular flange 190 has been added and cylindrical bearing surface 160 does not need to be present. Circular flange 190 is concentric with semi-circular end surface 155. Packing snow around all sides of flange 190 effectively fixes lower snow support 126A to the ground while still allowing rotation around axis of rotation 175.

Flange 190 is shown on the interior surface 145 of the lower snow support. However, it is possible to place flange 190 on either the interior or exterior surface, or on both surfaces at once. If flange 190 is placed on the exterior surface, accommodations would have to be made if the lower snow support is to function as a sled. One significant advantage of this embodiment is that fewer parts are required. Reducing the part count reduces the chance of losing a part in the snow. It may also reduce manufacturing costs.

Description

Alternative Embodiment

FIGS. 36, 37

Figure 36:
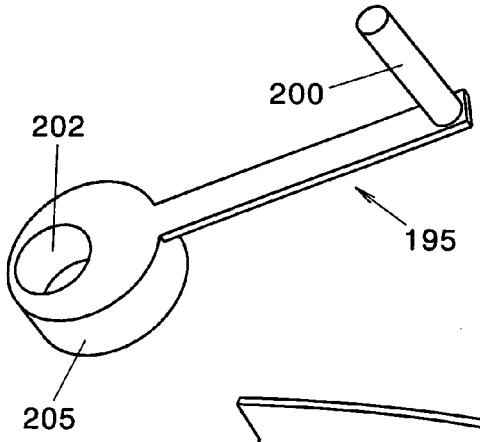
FIG. 36 is an isometric view of a back-off mechanism.

FIG. 36 shows back-off mechanism 195. This embodiment comprises two cylindrical, parallel, non-concentric bearing surfaces and a handle 200 for rotating the mechanism. The smaller cylindrical bearing surface 202 is the corresponding bearing surface for anchor 130 (FIG. 11). The larger cylindrical bearing surface 205 is the corresponding surface for cylindrical bearing surface 160A (FIG. 37) of snow support assembly 125C (FIG. 37).

Figure 37:
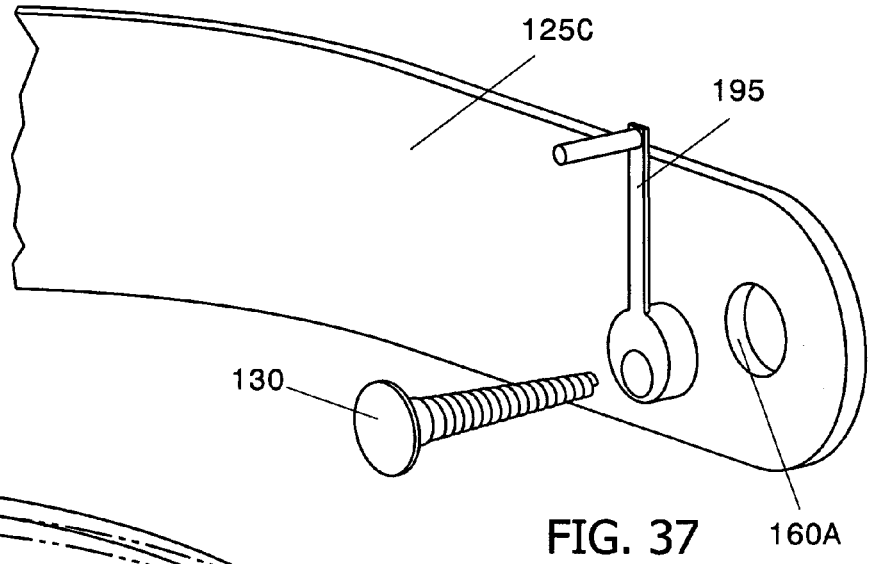
FIG. 37 is an exploded view containing a back-off mechanism.

FIG. 37 shows an exploded view of how the back-off mechanism is assembled to one embodiment of a shelter maker. Snow support assembly 125C is the same as snow support assembly 125 (FIG. 8) except that cylindrical bearing surface 160A in this embodiment is larger in diameter to accommodate larger cylindrical bearing surface 205. Anchor 130 passes through back-off mechanism 195 and through snow support assembly 125C.

Operation

Alternative Embodiment

FIG. 38

Figure 38:
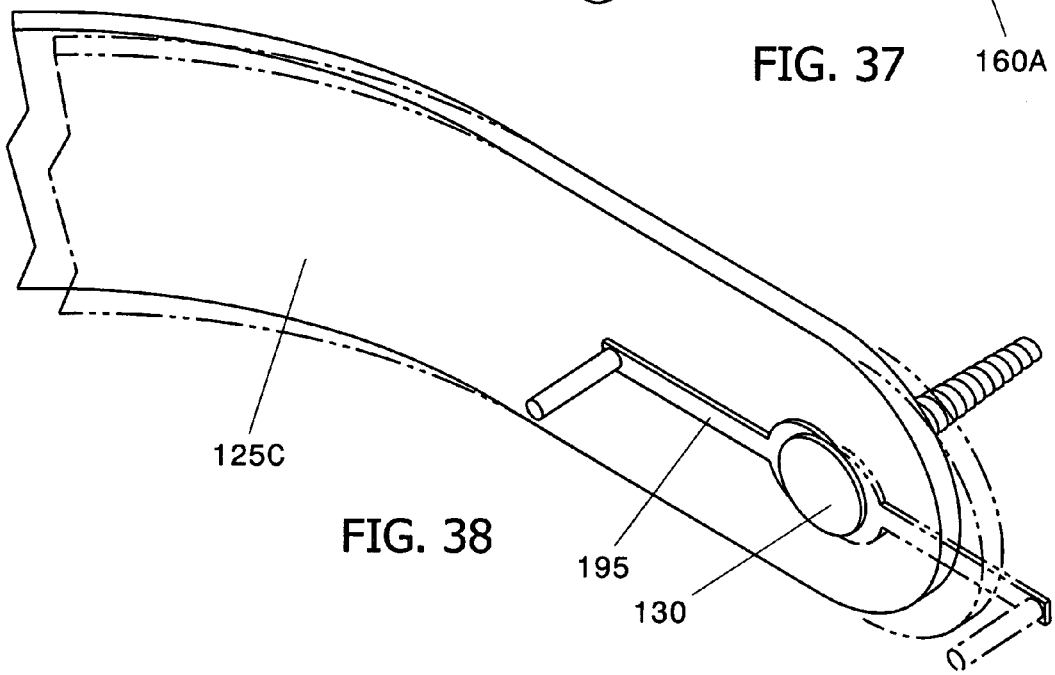
FIG. 38 is an isometric view of a back-off mechanism assembled to a snow support assembly.

FIG. 38 shows back-off mechanism 195 assembled to snow support assembly 125C and anchor 130. It also shows the motion of the snow support assembly when back-off mechanism 195 is rotated 180 degrees. When anchor 130 is fixed by snow, rotating the back-off mechanism by 180 degrees translates the snow support assembly a distance equal to twice the offset of the two cylindrical bearing surfaces 202 and 205 (FIG. 36). This causes apex 167 (see FIG. 8) of the snow support assembly to translate toward or away from the snow that has been packed around the exterior surface of the snow support. This motion allows a snow support assembly to be pulled free from packed snow and rotated to a new position.

Translating the apex 167 toward the snow after rotating the snow support prepares the device for the next layer. Back-off mechanism 195 can be used in conjunction with most embodiments of the snow support assembly but is most useful for those that do not have radius of curvature 170 described in FIG. 10.

Description

Alternative Embodiment

FIGS. 39 thru 44

Figure 39:
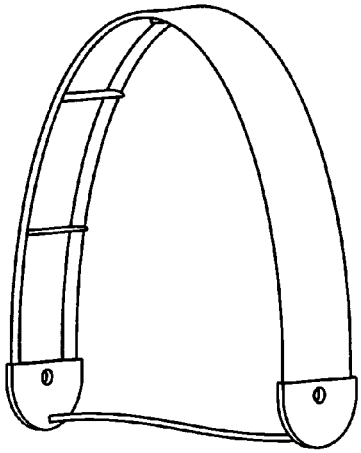
FIG. 39 is a alternative embodiment of a snow support assembly.

FIG. 39 shows another embodiment of a snow support assembly.

Figure 40:
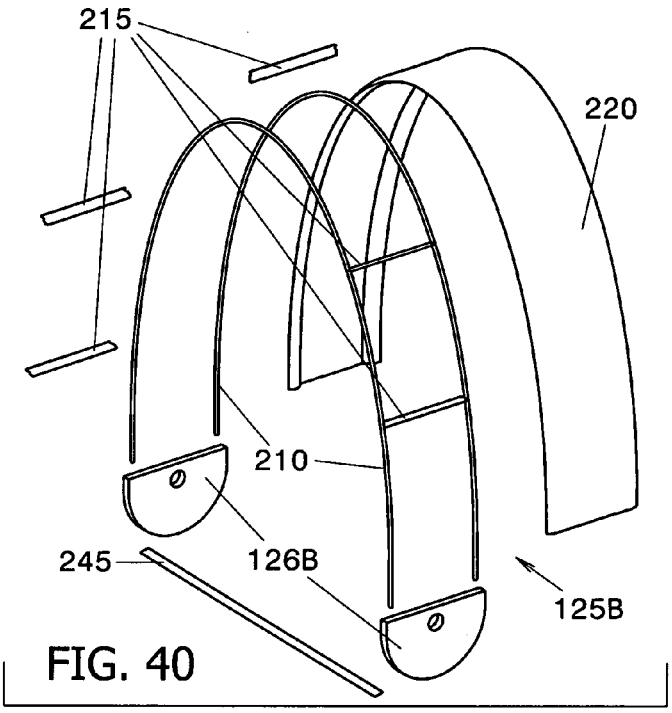
FIG. 40 is an exploded view of the snow support assembly shown in FIG. 39.

FIG. 40 is an exploded view of the snow support assembly shown in FIG. 39. It comprises two lateral poles 210, a plurality of spreader bars 215, a flexible surface member 220, two lower snow supports 126B, and tether 245. Lateral poles 210 could be of the flexible, shock-cord type of poles known in the art of camping tents. They could also be of the rigid form known in the art of camping tents. Spreader bars 215 are compression members that force lateral poles 210 apart which causes flexible surface member 220 to remain in a state of tension. This provides the necessary structural rigidity to support a snow load. Lateral poles 210 are connected to lower snow supports 126B. Tether 245 is a tension member that connects the two lower snow supports together when flexible lateral poles 210 are used. The tether holds lower snow supports 126B in the correct relative position until anchors 130 (see FIG. 43) can be fixed in snow. After fixing the anchors to the surface, the tether is removed so as not to be a trip hazard.

Figure 41:
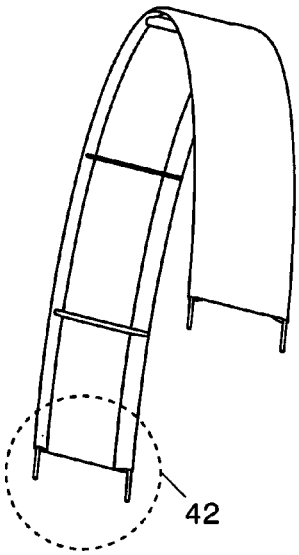
FIG. 41 is an isometric view of part of a snow support.
Figure 42:
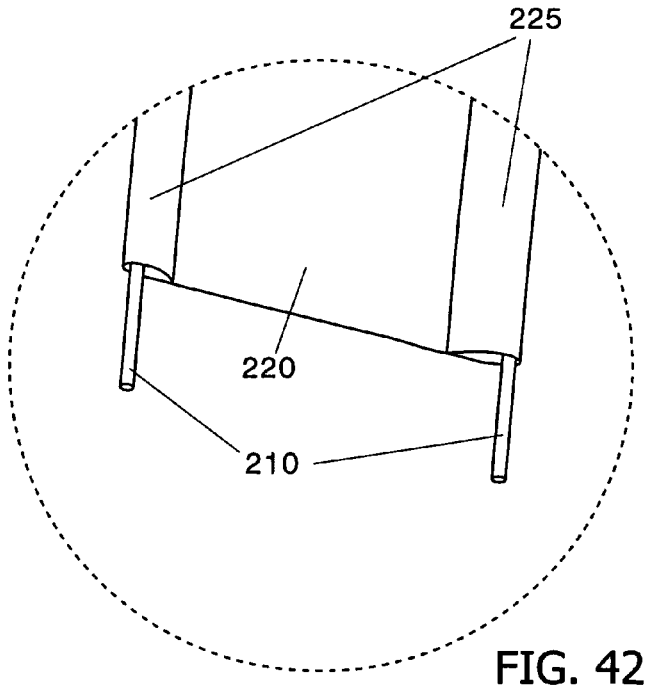
FIG. 42 is a detail view of part of FIG. 41.

FIG. 42 is a detail of FIG. 41 and shows how lateral poles 210 are inserted in tubular sleeves 225 that are formed along the lateral edges of flexible surface member 220. If necessary, additional poles (not shown) could also be integrated into this embodiment to add strength to the structure.

Figure 43:
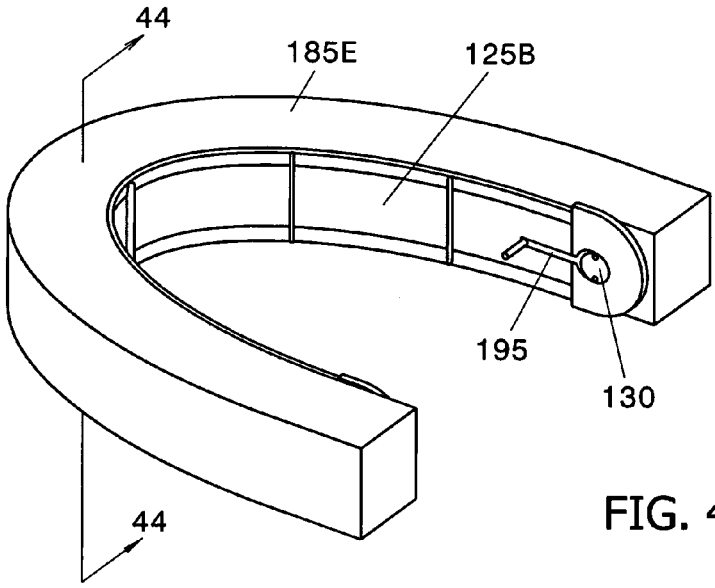
FIG. 43 is an isometric view of an alternative embodiment of a snow shelter maker and a partially completed shelter.

FIG. 43 shows snow support assembly 125B rotationally connected to back-off mechanism 195. Back-off mechanism 195 is rotationally connected to anchor 130. Snow 185E is packed around snow support assembly 125B.

Figure 44:
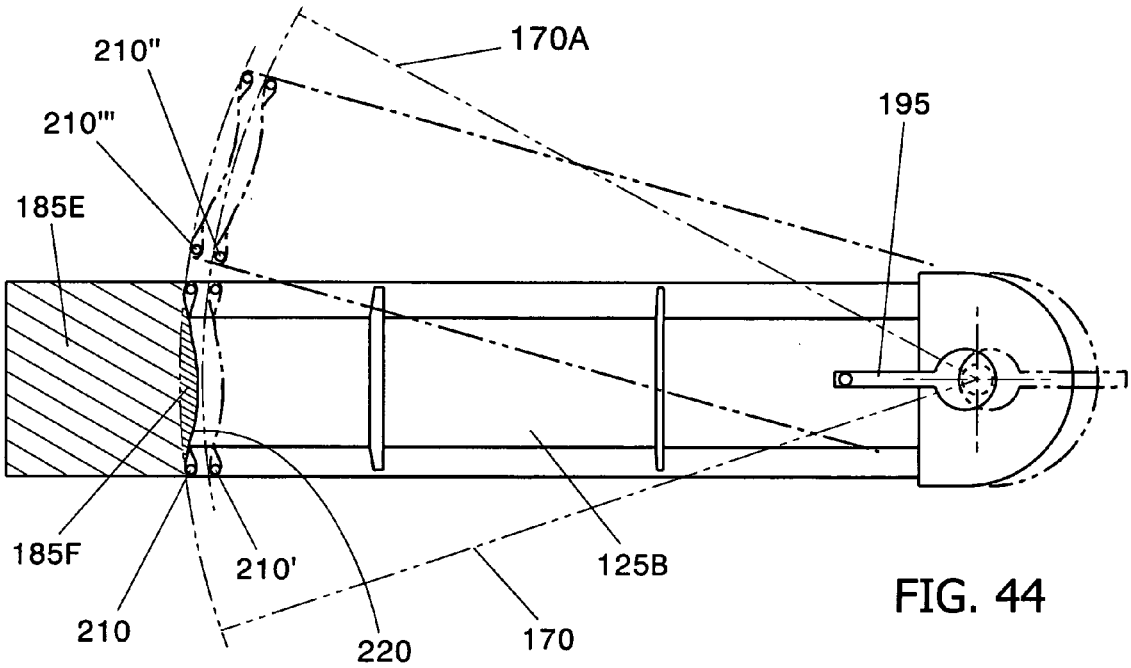
FIG. 44 is a cutaway view indicated by section line 44-44 in FIG. 43.

FIG. 44 is a section view defined by section line 44-44 in FIG. 43. This view shows how to use a snow support assembly that has an exterior surface that does not conform to the radius of curvature 170 of FIG. 10. In this embodiment, snow support assembly 125B has a flexible surface member 220 that does not rigidly conform to radius of curvature 170. Snow 185F (a subset of snow 185E) has been packed around snow support assembly 125B such that lower lateral pole 210 cannot directly rotate to lateral pole position 210''', as shown by radius of curvature 170. When back-off mechanism 195 is rotated 180 degrees, snow support assembly 125B translates such that lateral pole 210 moves to position 210'. At this point, radius of curvature 170A shows that lateral pole position 210' is clear of snow 185F. Snow support assembly 125B is rotated such that lateral pole 210' moves to position 210''. After rotation of snow support assembly 125B, back-off mechanism 195 is returned to its original position, which moves lateral pole 210'' to position 210'''. Construction of the next layer of snow may now continue. The operation of this embodiment is similar to the operation of the first embodiment except that snow support assembly 125B must be retracted from the packed snow before it can be rotated to a new position. Failure to back-off a snow support that is trapped by snow 185F can cause cracking of the packed snow. While these cracks in the shelter are often self healing, they can also cause portions of the unfinished shelter to collapse.

When disassembled, the compact nature of this embodiment may be of sufficient benefit to the user to make the additional steps required in building a shelter acceptable.

The inside surface of a shelter created with this embodiment will not have as smooth of a surface as that created by the first embodiment. Once again, the compact nature of this embodiment may outweigh the benefit of having a smoother interior surface.

Description

Alternative Embodiment

Figure 45:
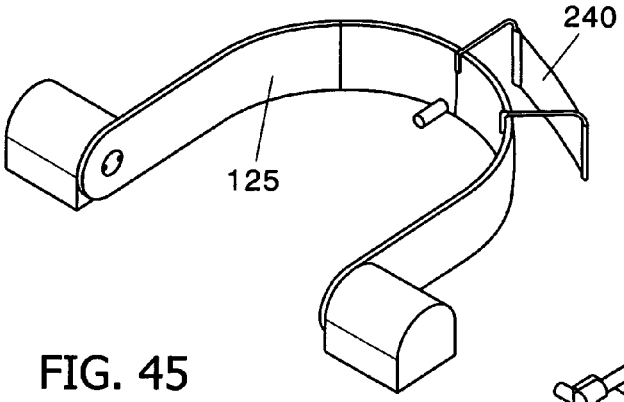
FIG. 45 is an isometric view of a snow retainer assembly attached to the first embodiment of a snow shelter maker.
Figure 46:
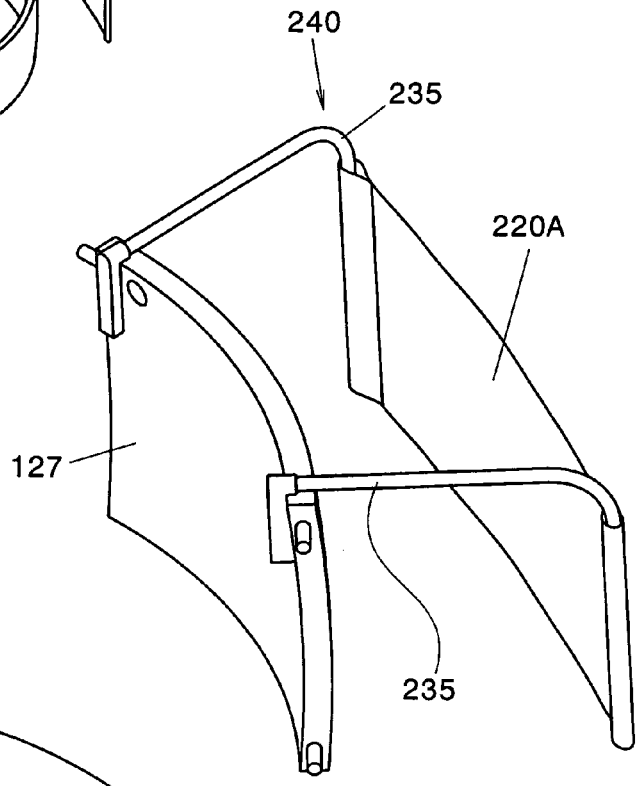
FIG. 46 is a close-up view of the snow retainer assembly shown in FIG. 45.
Figure 47:
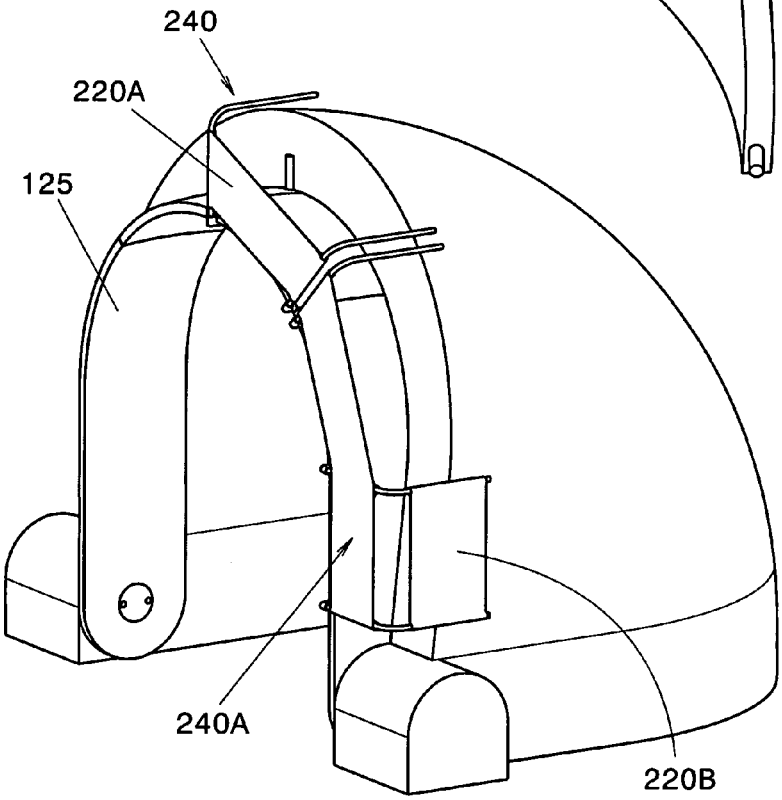
FIG. 47 is an isometric view of a snow retainer assembly during construction of a shelter.

FIGS. 45 thru 47

FIG. 45 demonstrates how a snow retainer assembly 240 can be added to snow support assembly 125.

FIG. 46 shows snow retainer assembly 240 attached to upper snow support 127. Similar snow retainer assemblies are envisioned surrounding the entire perimeter. This embodiment of snow retainer assembly 240 includes a flexible surface member 220A attached to rails 235 that are attached to upper snow support 127. The method of attachment is known in the art.

The function of snow retainer assembly 240 is to contain certain types of snow such as dry power that otherwise might be difficult to compact. The flexible surface member 220A is attached to rails 235 in such a way that it can be moved to a plurality of positions between two primary positions—parallel to the exterior surface of snow support assembly 125 (as shown in FIG. 45) or perpendicular to the exterior surface of the snow support assembly 125 (as shown in FIG. 47). These two primary positions are useful during different stages of construction. When the orientation of the snow support assembly is generally horizontal, placing the flexible surface member in the parallel position is desirable (FIG. 45). When snow support assembly 125 approaches a vertical orientation, the perpendicular position for flexible surface member 220A is desirable (FIG. 84). This keeps the snow from falling over the lateral edge of the snow support assembly until the snow is compacted.

Flexible surface member 220A would likely include multiple elastomeric cords or other methods known in the art to help it maintain an appropriate shape. In addition to the function of containing powdered snow prior to compaction, snow retainer assembly 240 has the added function of ensuring proper wall thickness.

Rails 235 are removable from snow support assembly 125 and reversible so that the snow retainer assembly can be used on either lateral side of snow support assembly 125. Snow retainer assembly 240 could be built in individual segments, as shown, or in segments such as snow retainer assembly 240A that extend over a larger area, including the entire perimeter. Additional flexible surface members 220B can be added to various locations around the perimeter during stages of construction to better contain loose snow.

Advantages

From the various embodiments of my snow shelter maker and from the method described, the following improvements become evident:

Physical effort is reduced during the construction process. Difficult work positions are avoided and the amount of snow that must be moved is reduced.

Snow is moved or lifted only once.

The embodiments and method are simple to use and do not require much practice.

The embodiments are easy to assemble, adjust, manipulate, and disassemble while the operator is wearing heavy gloves or mittens.

The embodiments accurately and quickly guide the construction of an appropriate sized shelter.

The shelter is sized and shaped to meet the needs of the users and thus reduces the snow required to build the shelter.

The shelter will have a smoother interior surface. Less rework is required and the chance of water drops forming is reduced.

The shelter will have an exterior surface with few voids to take full advantage of the insulation qualities of the snow.

It is possible for a single person to build an entire shelter.

Multiple people can work on a shelter simultaneously.

The number of sequential steps is reduced. Most of the work can be performed simultaneously. Snow can be added to the shelter even while the snow support assembly is being rotated.

A large working area is provided which reduces the number of movements of the embodiments.

Snow may be gathered from inside or outside the perimeter of the shelter.

The embodiments reduce trip hazards or obstacles and thus reduce the chance of damage to equipment or injury to the operator.

The embodiments and method promote simplicity of construction, including finishing the top of a shelter.

The embodiments and method promote rapid completion of a shelter.

The embodiment and method help ensure that adequate wall thickness is maintained.

The embodiment is easily portable.

CONCLUSION, RAMIFICATIONS, and SCOPE

Thus the reader will see that at least one embodiment of the snow shelter maker provides a faster and easier way to create a snow shelter. The embodiment also requires less work and less experience than prior art methods. Significant variations are envisioned that allow the snow shelter maker to be tailored to the needs and desires of the individual user.

While this apparatus and method are capable of creating a shelter of the traditional igloo shape, it is not limited to that shape but rather it is capable of many other variations and demonstrates many improvements in the art of building snow shelters.

As has been demonstrated, many different embodiments are envisioned. Other embodiments are envisioned in shape, material, color, secondary use, and form.

The components of the snow shelter maker can be made of many different materials and from many different manufacturing methods. For example, a metallic frame structure with a plastic or cloth skin attached functions properly as a snow support. A composite structure made of fiber reinforced plastics encasing foam or other light-weight core material also functions properly as a snow support assembly. The components can be made from injection-molded or blow-molded plastics. Numerous other materials and construction methods known in the art would also function properly.

Desirable qualities of the exterior surfaces include materials or coatings that are hydrophobic. A desirable surface or coating has a low coefficient of friction in relation to snow.

A bright color, such as red or orange, is desirable for all components of the snow shelter maker to help prevent any components from being lost in the snow. Some consumers, however, may prefer camouflage type coloring. Other colors may meet yet other needs of various consumers.

A cloth or plastic cover or envelope is envisioned for uses with the snow support assembly. The combination would function as a tent or shelter in the absence of adequate snow or when time does not allow for the building of a snow shelter.

Various embodiments have been shown for anchor 130. Others are envisioned that perform equivalent functions even though the physical embodiments vary significantly.

Other embodiments of angle support 135 are envisioned and may include ratcheting devices known in the art that allow the snow support assembly to rotate one direction around the axis of rotation but prevent rotation in the opposite direction. The location of such a ratcheting device could be located near and function in conjunction with an embodiment of an anchor, or, the ratcheting device could be located away from the axis of rotation and react against the previously compacted snow or the surface of construction. Another embodiment involves an extensible pole that would react against the compacted snow. Envisioned embodiments would be easily reversible so that the second half of the shelter could be formed.

Alternative embodiments of back-off mechanism 195 are also envisioned. Embodiments include combining the retraction/extension function in either the anchor or the snow support. If combined as part of a snow support assembly, the back-off function could be used with alternative embodiment of lower snow support 126A. One way of achieving this would be to incorporate the retraction/extension function of the mechanism at the joints between components of a snow support assembly.

Another envisioned embodiment involves creating a predetermined snow support surface that does not extend from anchor to anchor, but rather it is moved along a support structure that extends from anchor to anchor. The support structure would be rotated around the anchors just as snow support assemblies are in previous embodiments. While this embodiment may be compact, it has the disadvantage of requiring more manipulation by the user and thus slows down the construction process.

The embodiments shown are intended to demonstrate functionality. They have not necessarily been optimized for simplicity, manufacturing ease, manufacturing cost, or any other parameters desirable to the consumer, such as reduced weight. The functionality of each embodiment and components thereof may also be combined or separated in a variety of methods, some of which have been demonstrated.

The relative importance of the different advantages of the various embodiments would be determined by the user.

While my above description contains many specificities, these should not be construed as limitations on the scope, but rather as an exemplification of several preferred embodiments thereof. Many other variations are possible.

Accordingly, the scope should be determined not by the embodiments illustrated, but by the appended claims and their legal equivalents.

I claim:

1. A method for building a shelter of snow or ice crystals, comprising: a. positioning a snow support means in a generally horizontal orientation upon a construction surface, and b. securing said snow support means rotationally to said construction surface using anchor means, thus creating a generally horizontal axis of rotation, and c. securing said snow support means using angle support means, and d. packing snow to a predetermined thickness around exterior surface of said snow support means, and e. releasing said snow support means from said angle support means, and f. rotating said snow support means around said generally horizontal axis of rotation to expose at least a portion of said exterior surface of said snow support means, and g. repeating sequentially step c through step f until said snow support means reaches a substantially vertical orientation and one-half of said shelter is completed, and h. re-positioning said snow support means in a generally horizontal orientation and generally opposite the orientation of step a, and i. repeating steps c through f until shelter is fully enclosed, whereby said shelter is a predetermined surface of revolution created by rotating said snow support means about said generally horizontal axis of rotation.

2. A method for building a shelter of snow or ice crystals, comprising: a. attaching a snow retainer to a snow support means, and b. positioning said snow support means in a generally horizontal orientation upon a construction surface, and c. positioning a surface member 220A in a generally parallel orientation to exterior surface of said snow support means, and d. securing said snow support means rotationally to said construction surface using anchor means, thus creating a generally horizontal axis of rotation, and e. securing said snow support means using angle support means, and f. packing snow between exterior surface of said snow support means and said surface member, and g. releasing said snow support means from said angle support means, and h. rotating said snow support means around said generally horizontal axis of rotation to expose at least a portion of said exterior surface of said snow support means, and i. repeating sequentially step e through step h until said snow support means reaches approximately a 45 degree orientation from horizontal, and j. positioning said surface member 220A in a generally perpendicular orientation to exterior surface of said snow support means, and k. repeating sequentially step e through step h until said snow support means reaches a substantially vertical orientation and one-half of said shelter is completed, and l. re-attaching said snow retainer to opposite side of said snow support means, and m. positioning said snow support means in a generally horizontal orientation upon said construction surface and generally opposite the orientation of step a, and n. positioning a surface member 220A in a generally parallel orientation to exterior surface of said snow support means, and o. repeating steps e through k until said shelter is fully enclosed, whereby said shelter is a predetermined surface of revolution created by rotating said snow support means about said generally horizontal axis of rotation, said snow retainer helping contain powdered snow until compaction is achieved.

3. A method for building a shelter of snow or ice crystals, comprising: a. positioning a snow support means in a generally horizontal orientation upon a construction surface, and b. securing said snow support means rotationally to said construction surface using anchor means and a back-off means, thus creating a generally horizontal axis of rotation, and c. securing said snow support means using angle support means, and d. packing snow to a predetermined thickness around exterior surface of said snow support means, and e. releasing said snow support means from said angle support means, and f. backing off said snow support means from packed snow by using said back-off means, and g. rotating said snow support means around said generally horizontal axis of rotation to expose at least a portion of said exterior surface of said snow support means, and h. moving said snow support mean towards said packed snow using said back-off means, and i. repeating sequentially step c through step h until said snow support means reaches a substantially vertical orientation and one-half of said shelter is completed, and j. re-positioning said snow support means in a generally horizontal orientation and generally opposite the orientation of step a, and k. repeating steps c through h until shelter is fully enclosed, whereby said shelter is a predetermined surface of revolution created by rotating said snow support means about said generally horizontal axis of rotation.

4. A method for building a shelter of snow or ice crystals, comprising: a. positioning a snow support means in a generally horizontal orientation upon a construction surface, and b. securing said snow support means rotationally to said construction surface using anchor means, thus creating a first generally horizontal axis of rotation, and c. securing said snow support means using angle support means, and d. packing snow to a predetermined thickness around the exterior surface of said snow support means, and e. releasing said snow support means from said angle support means, and f. rotating said snow support means around said first generally horizontal axis of rotation to expose at least a portion of said exterior surface of said snow support means, and g. repeating sequentially step c through step f until said snow support means reaches a substantially vertical orientation and one end of said shelter is completed, and h. removing one or both of said anchors, and i. positioning said snow support means in a generally vertical orientation, and j. replacing said anchor or anchors that were removed in step h in a position that is less than or equal to the width of said snow support means, and k. packing snow to a predetermined thickness around exterior surface of said snow support means, and l. repeating steps h through k a predetermined number of times, m. re-positioning said snow support means in a generally horizontal orientation by rotating said snow support means about a second generally horizontal axis of rotation, securing said snow support means using said angle support means, and o. packing snow to a predetermined thickness around exterior surface of said snow support means, and p. releasing said snow support means from said angle support means, and q. rotating said snow support means around said second generally horizontal axis of rotation to expose at least a portion of said exterior surface of said snow support means, and r. repeating sequentially step n through step q until said snow support means reaches a substantially vertical orientation and a second end of said shelter is completed, whereby said first and second ends of said shelter are first and second predetermined surfaces of revolution created by rotating said snow support means about said first and second generally horizontal axes of rotation, respectively and the structure between said first and second ends has the profile of said snow support means.

* * * * *